US008295739B2

(12) United States Patent
Matsue et al.

(10) Patent No.: US 8,295,739 B2
(45) Date of Patent: Oct. 23, 2012

(54) DEVELOPMENT DEVICE AND IMAGE FORMING APPARATUS USING SAME HAVING MULTIPLE SUPPLY PORTS WHICH ARE DISPOSED AT DIFFERENT POSITIONS IN THE AXIAL DIRECTION

(75) Inventors: Natsumi Matsue, Ebina (JP); Junichi Matsumoto, Yokohama (JP); Tomoya Ohmura, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 411 days.

(21) Appl. No.: 12/631,331

(22) Filed: Dec. 4, 2009

(65) Prior Publication Data

US 2010/0143000 A1 Jun. 10, 2010

(30) Foreign Application Priority Data

Dec. 5, 2008 (JP) ..... 2008-311184

(51) Int. Cl.
*G03G 15/08* (2006.01)

(52) U.S. Cl. ..... 399/254; 399/255; 399/258; 399/260

(58) Field of Classification Search ..... 399/254–256, 399/258, 260
See application file for complete search history.

(56) References Cited

U.S. PATENT DOCUMENTS

| | | | | |
|---|---|---|---|---|
| 7,512,364 | B2 | 3/2009 | Muramatsu et al. | |
| 7,729,642 | B2 * | 6/2010 | Matsumoto et al. | 399/258 |
| 7,835,653 | B2 * | 11/2010 | Katoh et al. | 399/258 |
| 7,953,350 | B2 * | 5/2011 | Matsumoto et al. | 399/254 |
| 8,000,638 | B2 * | 8/2011 | Ohmura et al. | 399/254 |
| 8,014,703 | B2 * | 9/2011 | Ohmura et al. | 399/256 |
| 8,036,576 | B2 * | 10/2011 | Katoh et al. | 399/255 |
| 8,103,197 | B2 * | 1/2012 | Matsumoto et al. | 399/260 |
| 8,112,016 | B2 * | 2/2012 | Matsumoto et al. | 399/254 |
| 2007/0053721 | A1 | 3/2007 | Matsumoto et al. | |
| 2007/0053723 | A1 | 3/2007 | Iwata et al. | |
| 2007/0154242 | A1 | 7/2007 | Matsumoto et al. | |
| 2007/0166079 | A1 | 7/2007 | Ichikawa et al. | |
| 2007/0264053 | A1 | 11/2007 | Iwata et al. | |
| 2007/0274740 | A1 | 11/2007 | Katoh et al. | |
| 2008/0226349 | A1 | 9/2008 | Iwata et al. | |
| 2008/0298844 | A1 | 12/2008 | Katoh et al. | |
| 2008/0298845 | A1 | 12/2008 | Ohmura et al. | |
| 2008/0298866 | A1 | 12/2008 | Matsumoto et al. | |
| 2009/0028611 | A1 | 1/2009 | Matsumoto et al. | |
| 2009/0123174 | A1 | 5/2009 | Iwata et al. | |
| 2009/0185832 | A1 | 7/2009 | Muramatsu et al. | |

FOREIGN PATENT DOCUMENTS

| | | |
|---|---|---|
| JP | 11-143196 | 5/1999 |
| JP | 3483087 | 10/2003 |

* cited by examiner

*Primary Examiner* — William J Royer
(74) *Attorney, Agent, or Firm* — Oblon, Spivak, McClelland, Maier & Neustadt, L.L.P.

(57) ABSTRACT

A development device includes a development mechanism, an agitation unit connected to the development mechanism, to agitate and mix together developer collected from the development mechanism and fresh toner, and a transport member to transport the agitated developer from the agitation unit to a development portion. The development mechanism includes a developer carrier to carry developer, multiple supply ports disposed at different positions in an axial direction of the developer carrier, through which the agitated developer is supplied to the development mechanism, a discharge port, a developer supply member to supply developer to the developer carrier while transporting the developer in the direction parallel to the axial direction of the developer carrier, and a developer collection member to collect the developer from the developer carrier.

20 Claims, 17 Drawing Sheets

DEVELOPMENT DEVICE AND IMAGE FORMING APPARATUS USING SAME HAVING MULTIPLE SUPPLY PORTS WHICH ARE DISPOSED AT DIFFERENT POSITIONS IN THE AXIAL DIRECTION

CROSS-REFERENCE TO RELATED APPLICATIONS

This patent specification is based on and claims priority from Japanese Patent Application No. 2008-311184, filed on Dec. 5, 2008 in the Japan Patent Office, which is hereby incorporated by reference herein in its entirety.

BACKGROUND OF THE INVENTION

1. Field of the Invention

The present invention generally relates to a development device to develop an electrostatic latent image formed on a latent image carrier and an electrophotographic image forming apparatus, such as a copier, a facsimile machine, a printer, or a multifunction device including at least two of those functions, that includes the same.

2. Discussion of the Background Art

In general, electrophotographic image forming apparatuses, such as copiers, printers, facsimile machines, or multifunction devices including at least two of those functions and the like, include a latent image carrier on which an electrostatic latent image is formed, a development device to develop the electrostatic latent image with developer, and a transfer unit to transfer the developed image (toner image) onto a sheet of recording media. The electrostatic latent image formed on the latent image carrier is developed with either one-component developer consisting of toner or two-component developer including toner and magnetic carrier.

In development devices using two-component developer, the toner concentration in the developer supplied to a development sleeve, serving as a development member, should be kept constant to maintain a constant image density of resulting images.

So-called unidirectional development devices, in which the developer is circulated unidirectionally within a closed circulation path, typically use separate screws to supply the developer to the development sleeve prior to development of the electrostatic latent image and to collect the developer from the development sleeve after development. Certain other known development devices include a separate agitation unit or container containing the toner and the carrier. In the agitation unit, the developer is agitated so that the toner concentration is adjusted to a desired concentration and the toner is charged, and only then the developer is supplied to the development device.

Screws are typically used as agitation members or developer transport members to transport and agitate the developer in the development devices. Certain known development devices use a toner concentration adjuster to adjust the ratio of toner to carry in a container portion. However, when the screw is used as the developer transport member, the amount of charge (hereinafter "charge amount") of the developer depends on the distance the developer is transported (hereinafter "transport distance") because the screw agitates the developer while transporting the developer. Thus, the developer charge amount in not uniform but differs depending on the position in the development device at which the developer is carried on the development sleeve, causing differences in the image density of the formed images.

In view of the foregoing, there is a need for the development device to reduce differences in the charge amount of the developer caused by the differences in the transport distance of the developer and thus provide more uniformly charged developer.

SUMMARY OF THE INVENTION

In view of the foregoing, one illustrative embodiment of the present invention provides a development device to develop a latent image with developer, that includes a development mechanism, an agitation unit connected to the development mechanism, and a transport member to transport the developer from the agitation unit to the development mechanism.

The development mechanism includes multiple supply ports through which developer is supplied to the development mechanism, a discharge port through which the developer is discharged from the development mechanism, a developer carrier to carry the developer, a developer supply member extending in a direction parallel to the axial direction of the developer carrier, to supply the developer to the developer carrier while transporting the developer in the direction parallel to the axial direction of the developer carrier, and a developer collection member disposed in parallel to the developer supply member, to collect the developer from the developer carrier. The agitation unit agitates and mixes together the developer collected from the development mechanism and fresh toner, and the transport member transports the agitated developer from the agitation unit to the multiple supply ports provided in the development mechanism through a developer transport path. The multiple supply ports are disposed at different positions in the development mechanism in the axial direction of the developer carrier.

In another illustrative embodiment of the present invention, a development device includes, instead of both the developer supply member and the developer collection member, a single developer transport member extending in a direction parallel to an axial direction of the developer carrier, to transport the developer within the development mechanism in the direction parallel to the axial direction of the developer carrier. The developer transport member supplies the developer to the developer carrier while collecting the developer from the developer carrier.

Yet another illustrative embodiment provides an image forming apparatus that includes a latent image carrier, a latent image forming unit to form a latent image on the latent image carrier, and the development device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
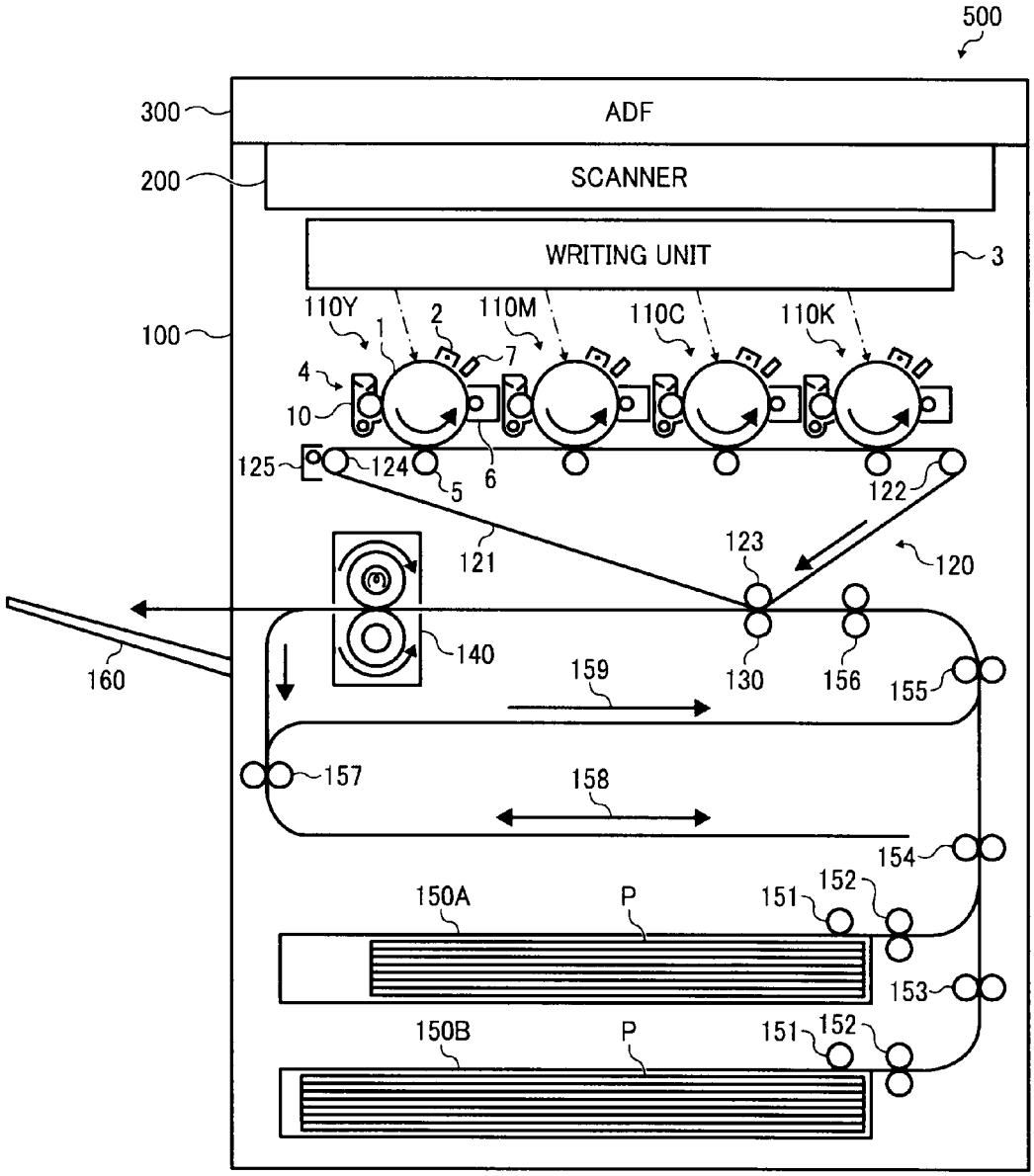
FIG. 1 is a schematic view illustrating a configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a color image forming system according to an illustrative embodiment of the present invention is described.

(Image Forming Apparatus)

FIG. 1 illustrates a configuration of an image forming apparatus according to the present embodiment. The image forming apparatus according to the present embodiment is a multifunction machine capable of copying, printing, and facsimile transmitting and can be switched among these functions with a switch key provided in an operation panel, not shown.

It is to be noted that the subscripts Y, M, C, and K attached to the end of each reference numeral indicate only that components indicated thereby are used for forming yellow, magenta, cyan, and black images, respectively, and hereinafter may be omitted when color discrimination is not necessary.

Although FIG. 1 illustrates a tandem intermediate-transfer type multicolor image forming apparatus 500 that includes four image forming units 110Y, 110M, 110C, and 110K disposed in parallel to each other along an intermediate transfer unit 120, the image forming apparatus according to the present embodiment is not limited thereto but can be a tandem direct-transfer image forming apparatus, a single-drum type multicolor intermediate-transfer image forming apparatus, or monochrome image forming apparatus including only a single image forming unit.

A configuration and an image forming operation of the image forming apparatus 500 shown in FIG. 1 are described below.

As shown in FIG. 1, the image forming apparatus 500 includes a main body 100 to perform the image forming operation, a scanner 200 to read image data of original documents, disposed above the main body 100, and an automatic document feeder (ADF) 300 disposed above the scanner 200. The ADF 300 is closably openable with respect to the scanner 200 and feeds the original documents to a document table (e.g., contact glass) of the scanner 200.

In the main body 100, the image forming units 110Y, 110M, 110C, and 110K for forming yellow (Y), magenta (M), cyan (C), and black (B) toner images, respectively, are arranged in parallel to each other along the intermediate transfer unit 120. The image forming units 110Y, 110M, 110C, and 110K have a similar configuration except for the color of toner used therein. Each image forming unit 110 includes a photoconductor 1 that is a drum-shaped rotary member, and a charging member 2 (e.g., charger or charging roller) a development device 4, a primary transfer roller 5, serving as a primary transfer member, a photoconductor cleaner 6, and a quenching lamp 7 that removes electricity from a surface of the photoconductor 1 are arranged around the photoconductor 1. It is to be noted that, regarding the development device 4, only a development mechanism 10 thereof is illustrated in FIG. 1.

A writing unit 3 serving as a latent image forming unit is disposed above the image forming units 100 and directs writing light (e.g. laser beam) corresponding to respective colors onto the surfaces of the photoconductors 1 according to the image data. For example, the writing unit 3 may include laser light sources, a deflection member such as a polygon mirror to deflect the laser beams, and optical scanning systems. Alternatively, the writing unit 3 may includes a linearly arranged array of light-emitting diodes (LEDs) and imaging systems.

The intermediate transfer unit 120 is disposed beneath the four image forming units 110 and includes an intermediate transfer member 121 wound around multiple rollers 122, 123, and 124, and a belt cleaning unit 125. For example, the intermediate transfer belt 121 is an endless belt (hereinafter "intermediate transfer belt 121"). Single-color toner images formed on the photoconductors 1 in the respective image forming units 110 are primarily transferred onto the intermediate transfer belt 121.

Additionally, a secondary transfer roller 130 to transfer the toner image from the intermediate transfer belt 121 onto a sheet of recording media (e.g., recording sheet) is provided beneath the intermediate transfer unit 120. Sheet cassettes 150A and 150B respectively contain multiple sheets P are provided in a lower portion of the main body 100 detachably from the main body 100. The sheet cassettes 150A and 150B can contain different sizes of sheets P. The sheets P are fed from either the sheet cassette 150A or 150B one by one by a pickup roller 151 and a feed roller 152 to a secondary transfer nip, where the secondary transfer roller 130 presses against the intermediate transfer belt 121.

Then, the sheets P are transported by transport rollers 153, 154, and 155 upward through a sheet feed path in FIG. 1, and a pair of registration rollers 156 forwards the sheet P at a predetermined timing to the secondary transfer nip. The image forming apparatus 500 further includes a fixing device 140, a sheet reverse unit 158 through which the sheet P is reversed in duplex printing, and a re-feeding path 159 through which the reversed sheet P is again transported to the secondary transfer nip. The fixing device 140 is disposed downstream from the secondary transfer roller 130 in a direction in which the sheet is transported (hereinafter "sheet transport direction") and fixes the toner image transferred onto the sheet P thereon.

A bifurcation point where the transport route of the sheet P is switched is provided downstream from the fixing device 140 in the sheet transport direction, and the transport route of the sheet P is switched between a discharge path leading to a discharge tray 160 and the sheet reverse unit 158 leading to the re-feeding path 159.

The image forming operation performed in the above-described image forming apparatus 500 is described below. When a command to start printing is input, the respective photoconductors 1, rollers in the units around the photoconductors 1, a driving roller (122, 123, or 124) of the intermediate transfer belt 121, and the respective transport rollers 153, 154, and 155 disposed along the sheet transport paths start rotating at a predetermined or given timing. Simultaneously, the selected size of sheet P is sent from the sheet cassette 150A or 150B.

Meanwhile, in each image forming unit 110, the surface of the photoconductor 1 is charged uniformly, and then the writing unit 3 directs the writing light (laser beam) onto the surface of the photoconductor 1 according to the image data, that is, the surface of the photoconductor 1 is exposed to the writing light. An electrical potential pattern on the exposed photoconductor 1 is called an electrostatic latent image, and the development mechanism 10 of the development device 4 supplies toner to the electrostatic latent image, thus developing it into a toner image.

Because the configuration shown in FIG. 1 includes four photoconductors 1 respectively corresponding to yellow, magenta, cyan, and black, Y, M, C, and K single-color images are formed on the respective photoconductors 1. It is to be noted that the arrangement order of Y, M, C, and K varies from apparatus to apparatus. Then, the single-color toner images are transferred from the respective photoconductors 1 onto the intermediate transfer belt 121 in portions where the primary transfer rollers 5 press against the respective photoconductors 1 via the intermediate transfer belt 121 (hereinafter "primary transfer nips"). Each primary transfer roller 5 receives a primary transfer bias and transfers the toner image from the photoconductor 1 onto the intermediate transfer belt 121 with pressure and effects of the primary transfer bias. While this primary transfer process is performed in the four image forming units 110, the toner images are superimposed one on another on the intermediate transfer belt 121, forming a multicolor toner image thereon.

Then, the registration rollers 156 forward the sheet P to the secondary transfer nip, timed to coincide with the arrival of the multicolor toner image formed on the intermediate transfer belt 121, and the multicolor toner image is secondarily transferred onto the sheet P in the secondary transfer nip. The secondary transfer roller 130 receives a secondary transfer bias and transfers the toner image onto the sheet P with pressure and effects of the primary transfer bias. Then, while the sheet P passes through the fixing device 140, the toner image is fixed thereon with heat and pressure.

In single-side printing, in which images are formed on only one side of the sheet P, the sheet P is linearly transported and then discharged onto the discharge tray 160. By contrast, in duplex printing, in which images are formed on both sides of the sheets P, the sheet P is transported downward from the bifurcation point to the sheet reverse unit 158 via a pair of switchback rollers 157.

In the sheet reverse unit 158, the switchback rollers 157 reverse the transport direction of the sheet P, and thus the sheet P exits the sheet reverse unit 158 from its trailing edge. This operation is called "switchback operation", by which the sheet P is turned upside down, that is, reversed. The reversed sheet P is then transported not to the fixing device 140 but to the sheet feed path again through the re-feeding path 159. Then, another toner image is transferred onto the back side (e.g., second side) of the sheet P in the secondary transfer nip, after which the sheet P passes through the fixing device 140 and is discharged onto the discharge tray 160. Thus, duplex printing is completed.

Subsequent operations of the respective portions are as follows: Since a certain amount of toner tends to remain untransferred on each photoconductor 1 that has passed the primary transfer nip, the photoconductor cleaner 6, formed by a blade, a brush and the like, removes the untransferred toner therefrom. Then, the quenching lamp 7 discharges the surface of the photoconductor 1, and thus the photoconductor 1 is prepared for a subsequent charging process. Similarly, the belt cleaning device 125, formed by a blade, a brush, etc., removes any toner remaining on the intermediate transfer belt 121 that has passed the secondary transfer nip, and thus the intermediate transfer belt 121 is prepared for a subsequent transfer process. The above described processes are repeated in single-side printing or duplex printing.

The development device 4 in the above-described image forming apparatus 500 according to the present embodiment has a distinctive feature in the development device 4. The development device 4 according to the various embodiments can produce high-quality images in which unevenness in image density is reduced. The configuration of the development device 4 according to the present embodiment is described below.

(Development Device)

Figure 2:
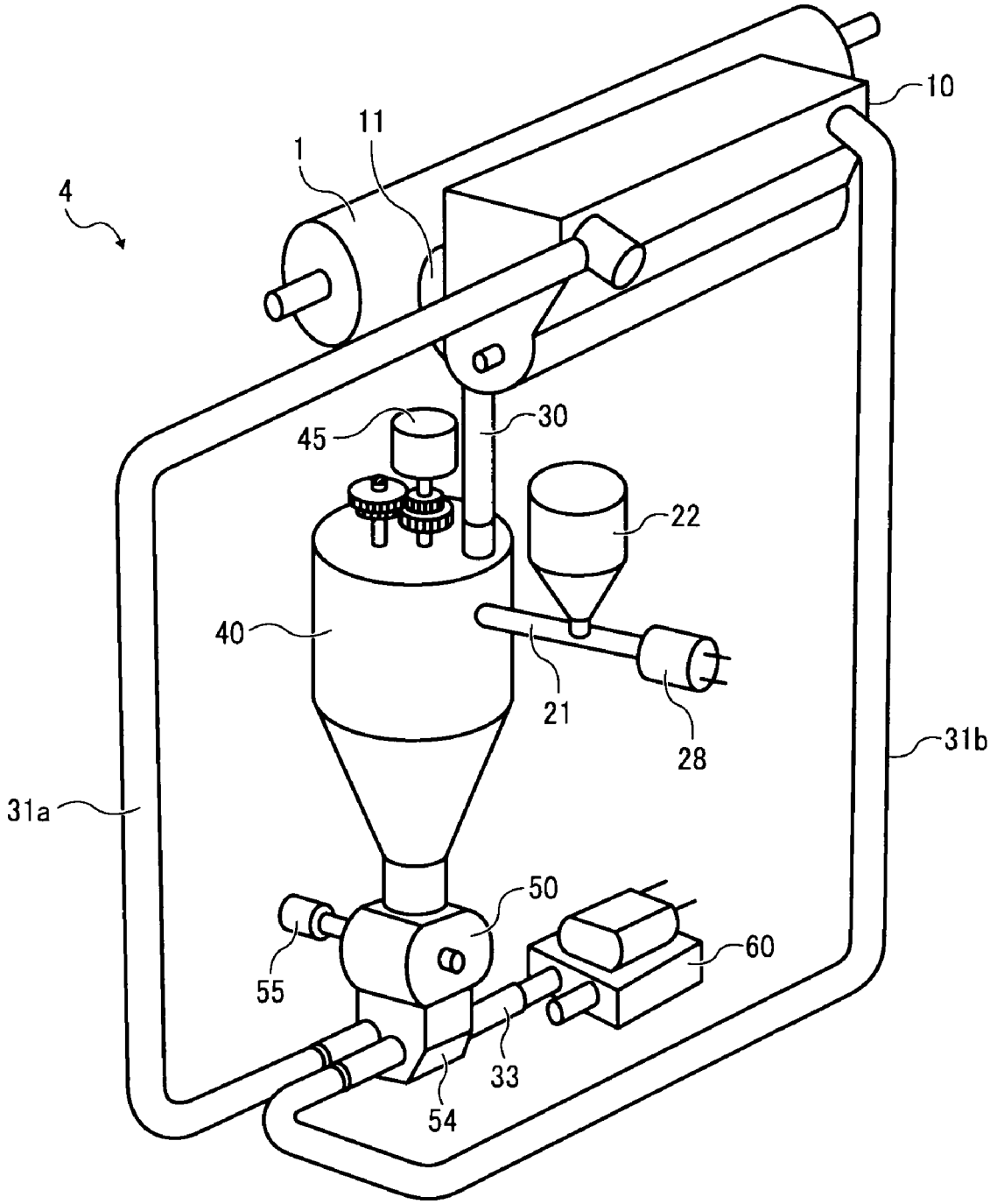
FIG. 2 is a schematic view illustrating a configuration of a development device according to an illustrative embodiment of the present invention.

FIG. 2 illustrates an overall configuration of the development device 4 that uses the two-component developer including toner and carrier.

Referring to FIG. 2, the development mechanism 10 is disposed facing the photoconductor 1 and develops an electrostatic latent image formed on the photoconductor 1 with the developer (e.g., toner) into a toner image. Then, the toner image formed on the photoconductor 1 is transferred onto the sheet P and then fixed thereon by the fixing device 140.

The development device 4 further includes a developer carrier 11 disposed adjacent to and facing the photoconductor 1. The developer carrier 11 is a rotary member to supply the developer to the photoconductor 1, thus developing the electrostatic latent image.

Figure 3:
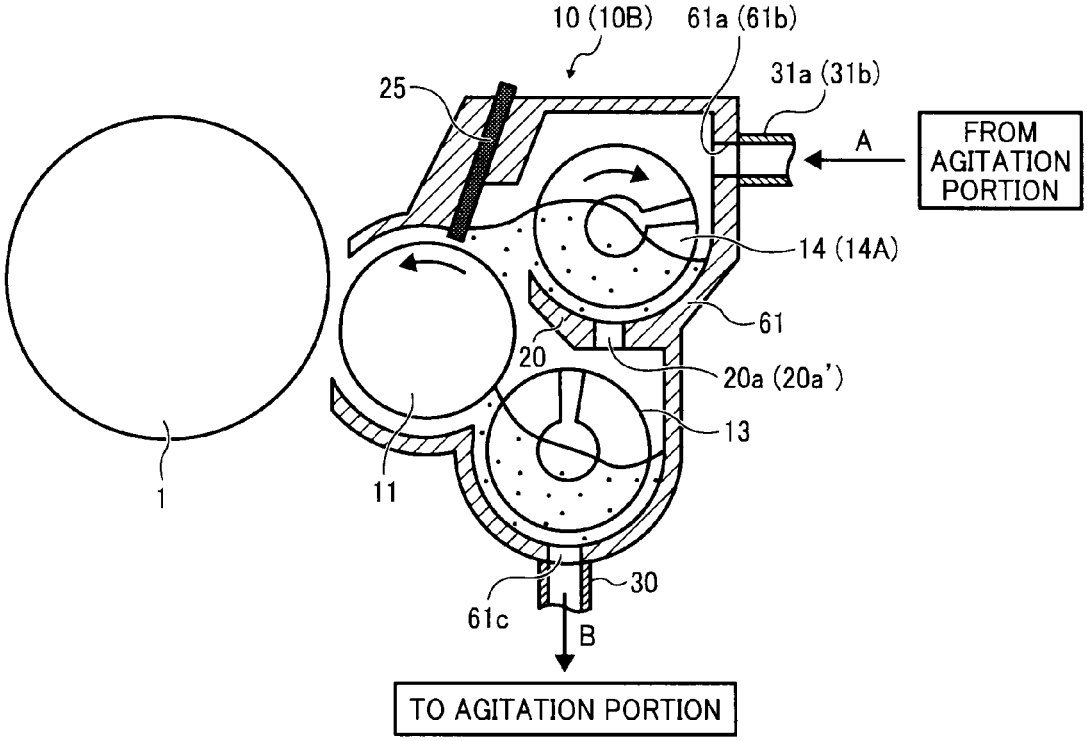
FIG. 3 illustrates a cross section of a development mechanism perpendicular to the longitudinal direction of the developer carrier.

The development mechanism 10 includes a supply screw 14 and a collection screw 13, both of which are shown in FIG. 3. In the present embodiment, the supply screw 14 and the collection screw 13 together forms a developer transport member that supplies the developer (e.g., toner and carrier) to the developer carrier 11 and collects the developer therefrom while transporting the developer in the development mechanism 10 in parallel to a rotational axis (hereinafter "axial direction") of the developer carrier 11. The supply screw 14, serving as a developer supply member, supplies the developer to the developer carrier 11 while transporting the developer from both end portions to a center portion in the axial direction, and the collection screw 13, serving as a developer collection member, collects the developer from the developer carrier 11 while transporting the developer unidirectionally from right to left in FIG. 4B. The collected developer is circulated in the development device 4 via an agitation unit 40 disposed beneath the development mechanism 10 in FIG. 2, which is downstream from the development mechanism 10 in a direction in which the developer is agitated.

Circulation of the developer is described below.

As the toner in the two-component developer is consumed to develop latent images formed on the photoconductor 1, the concentration of toner in the developer decreases accordingly. Then, the developer whose toner concentration is decreased is transported through a tube 30 to the agitation unit 40, where the collected developer is mixed with fresh toner supplied from a toner bottle 22. The tube 30, the agitation unit 40, a rotary feeder 50, a discharge space 54, and tubes 31*a* and 31*b* together form a developer circulation path. The rotary feeder 50 and the discharge space together 54 form a discharge unit. The tubes 31*a* and 31*b* may serve as sub-paths, and the tubes 31*a* and 31*b* and the discharge space 54 may together form a developer transport path from the agitation unit 40 to the development mechanism 10. The tubes 31*a* and 31*b* may also serve as connectors connecting the development mechanism 10 and the agitation unit 40 via the discharge unit. The developer transport path may be pipe or the like.

The agitation unit 40 is cylindrical and extends vertically, and a screw 42 and a rotary blade 43 (shown in FIG. 13), serving as agitation members, are provided in the agitation unit 40. The screw 42 and the rotary blade 43 are driven by a motor 45 disposed above the agitation unit 40 in FIG. 2.

A toner supply tube 21 is connected to a side of the agitation unit 40, and the toner bottle 22 as well as a motor 28 are connected to the toner supply tube 21 so that the toner is supplied from the toner bottle 22 through the toner supply tube 21 to the agitation unit 40 to compensate for the consumed toner. More specifically, when it is detected that the toner concentration is insufficient, the motor 28 drives a screw, not shown, provided in the toner supply tube 21 to supply the toner from the toner bottle 22 to the agitation unit 40.

A toner concentration sensor 17 (shown in FIG. 4B) is provided close to the collection screw 13 provided in the development mechanism 10, and a controller, not shown, determines the amount of the toner supplied through the toner supply tube 21 according to results of detection by the toner concentration sensor 17. Alternatively, the toner concentration sensor 17 may be disposed inside or outside the tube 30. In the agitation unit 40, the toner supplied from the toner bottle 22 through the toner supply tube 21 and the developer collected from the development mechanism 10 through the tube 30 are agitated and mixed together, and thus the toner is charged frictionally and dispersed uniformly in the developer.

Figure 15:
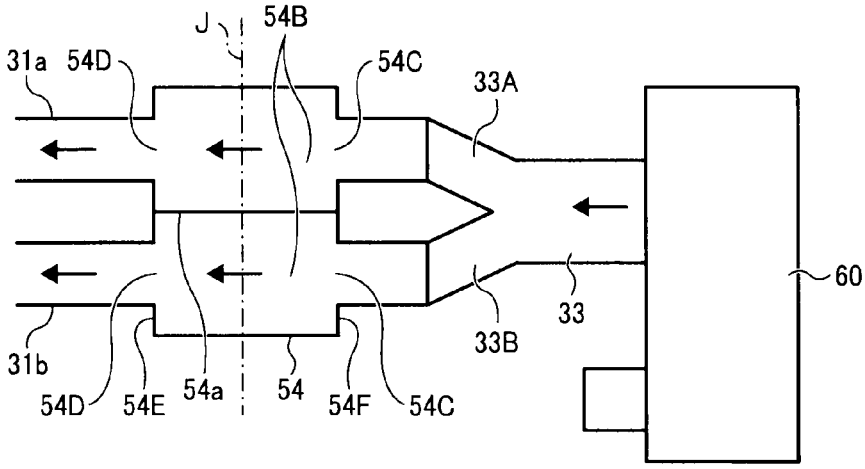
FIG. 15 is a cross section of the configuration shown in FIG. 14 indicated by arrow A-A shown in FIG. 14

Additionally, the rotary feeder 50 that feeds the developer to the development mechanism 10 and a motor 55 to drive the rotary feeder 50 are provided beneath the agitation unit 40, and the discharge space 54 is provided beneath the rotary feeder 50. The developer agitated in the agitation unit 40 flows down to the rotary feeder 50, and is further discharged by the rotation of the rotary feeder 50 into the discharge space 54 that is a space surrounded by walls. The discharge space 54 communicates with a tube 33 through which air generated by an air pump 60, serving as an airflow generating system, is sent to the discharge space 54. The tube 33 connected to the air pump 60 bifurcates into two, bifurcated tubes 33A and 33B, close to the discharge space 54 as shown in FIG. 15. The discharge space 54 also communicates with the development mechanism 10 via the tubes 31*a* and 31*b* serving as developer transport paths through which the developer is transported from the agitation unit 40 to supply ports 61*a* and 61*b* formed in the development mechanism 10. The air pump 60 serves as a transport member to transport the agitated developer from the agitation unit 40 to the multiple supply ports formed in the development mechanism 10. Alternatively, the transport member to transport the agitated developer from the agitation unit 40 to the development mechanism 10 may be a screw or the like.

The developer discharged from the agitation unit 40 is transported through the tubes 31*a* and 31*b*, together with compressed air that is generated by the air pump 60 and sent through the tube 33, to the development mechanism 10. It is preferable that the tubes 31*a* and 31*b* have identical or similar length. The developer is transported through the tubes 31*a* and 31*b* with airflow. When the developer is transported by air, although the stress to the developer can be smaller compared with the case in which the developer is transported by a screw, the charge amount of the developer can fluctuate. In this case, the difference in the distance by which the developer is transported can be smaller between the two tubes 31*a* and 31*b* when the tubes 31*a* and 31*b* have an identical or similar length, and thus the difference in the charge amount of the developer is reduced.

End portions (e.g., supply ports) of the tubes 31*a* and 31*b* are respectively connected to a left end portion and a right end portion of the development mechanism 10 in the longitudinal direction (axial direction) thereof in FIG. 2. It is to be noted that hereinafter "axial direction" means that of the developer carrier 11 unless otherwise specified. The amount of the developer transported to the development mechanism 10 is determined by the rotational velocity of the rotary feeder 50 and the amount of air pumped by the air pump 60. In the tube 30, the developer is transported due to gravity, thus obviating the need for an air pump. The tubes 30, 31*a*, and 31*b* can be formed of flexible material such as silicone.

The development mechanism 10 is described in further detail below with reference to FIGS. 3, 4A, and 4B.

FIG. 3 illustrates a cross section of the development mechanism 10 perpendicular to the axial direction (e.g., longitudinal direction) of the developer carrier 11. FIG. 4A illustrates a cross section of the development mechanism 10 partially, viewed from above, and FIG. 4B illustrates a cross section of a lower portion of the development mechanism 10 partially, viewed from a side. In FIG. 4A, reference characters L1 and L2 respectively represent distances by which the developer may be transported by a left portion and a right portion of the supply screw 14. The development mechanism 10 according to the present embodiment has a specific feature in that two supply ports 61*a* and 61*b* are formed in an upper portion of the development mechanism 10, respectively in both end portions thereof in the longitudinal direction for the developer supplied to the development mechanism from the agitation unit 40.

The position of the development mechanism 10 in the development device 4 is as described above with reference to FIG. 2.

Referring to FIG. 3, the developer carrier 11 disposed close to the photoconductor 1, the collection screw 13, and the supply screw 14 are housed in a housing 61. Supply ports 61*a* and 61*b*, and a discharge port 61*c* respectively communicating with the tubes 31*a*, 31*b*, and 30 are formed in the housing 61.

The developer carrier 11 is a development roller outer circumferential portion of which is formed of a nonmagnetic cylindrical development sleeve, and a magnetic field generator such as a magnetic roller or multiple magnets are provided therein. The development sleeve rotates around the magnet roller (or multiple magnets) that remains motionless. The developer carrier 11 magnetically carrying the developer on a surface of the development sleeve rotates and supplies the developer to the photoconductor 1, thus developing the electrostatic latent image formed thereto with the toner in the developer. In the development mechanism 10, the collection screw 13 and the supply screw 14 are arranged vertically on both sides of a partition 20 in parallel to the axis of the developer carrier 11 as shown in FIGS. 3, 4A and 4B. The collection screw 13 does not immediately supply the developer (hereinafter "used developer") that has passed a development region where the developer carrier 11 faces the photoconductor 1 to the developer carrier 11 but collects and then sends the used developer through the discharge port 61*c* to the agitation unit 40 shown in FIG. 2. The supply screw 14 is disposed above the collection screw 13 and supplies the developer agitated in the agitation unit 40 to the developer carrier 11. As shown in FIG. 3, a doctor 25 is disposed with its edge portion across a given gap (hereinafter "doctor gap") from the surface of the developer carrier 11, and the amount of the developer carried on the developer carrier 11 is adjusted when the developer passes through the doctor gap.

The developer is further carried by the developer carrier 11 to the development region and then used in the development process. By contrast, unused developer, which includes the developer removed by the doctor 25 from the developer carrier 11 as well as the developer that is not used in the development process, reaches the lower portion of the development mechanism 10 where the collection screw 13 is disposed. In the present embodiment, as shown in FIG. 4A, an opening 20*a* is formed in a center portion of the partition 20 in the axial direction of the developer carrier 11. The left portion and the right portion of the supply screw 14 transport the developer from the respective end portions to the center portion in the axial direction in parallel to the axial direction. Because the supply screw 14 supplies the developer to the developer carrier 11 while thus transporting the developer, the amount of developer transported decreases as the developer approaches to the opening 20*a*. In other words, the developer supplied through the supply port 61*a* and supplied through the supply port 61*b* are transported up to the distance indicated by arrows L1 and L2 (hereinafter "developer transport distance"), respectively.

Figure 4A:
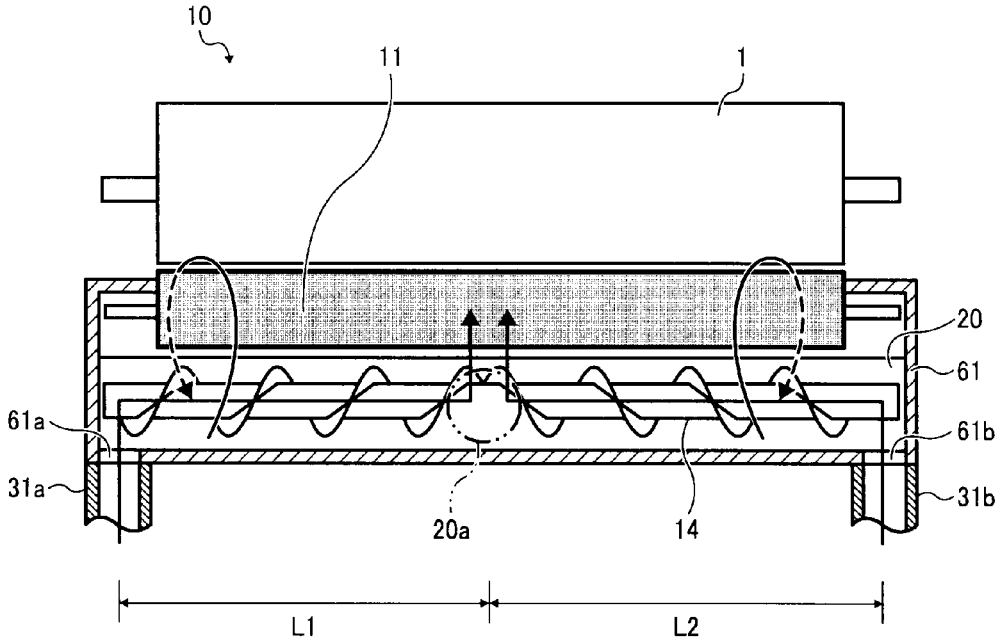
FIG. 4A partially illustrates a cross section of a development mechanism viewed from above in FIG. 3.
Figure 4B:
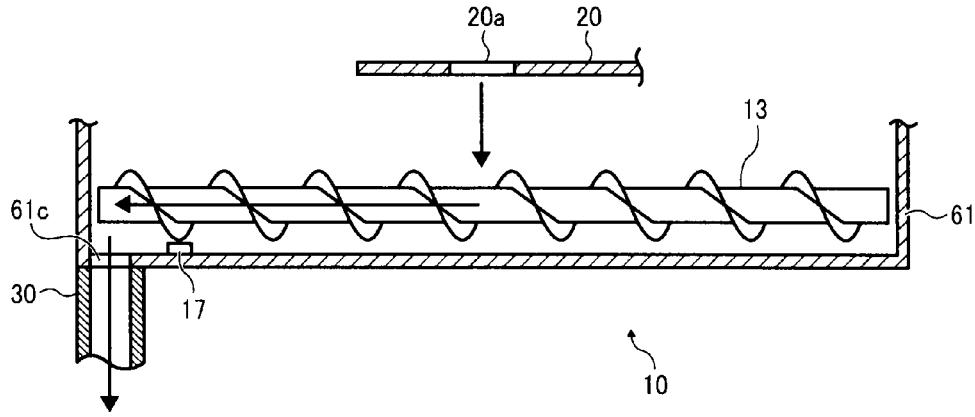
FIG. 4B illustrates a cross section of a lower portion of the development mechanism viewed from a side in FIG. 3.

In the lower portion of the development mechanism 10, the developer that has passed the development region is collected by rotation of the collection screw 13 to the left end portion of the development mechanism 10 in FIG. 4B where the discharge port 61*c* is disposed. The developer is transported to the agitation unit 40 through the tube 30 that communicates with the discharge port 61*c* disposed in the left end portion of the development mechanism 10, that is, a downstream end portion in the direction in which the collected developer is transport by the collection screw 13 in the development mechanism 10. Thus, the agitation unit 40 is connected via the tube 30 to the downstream end portion of the development mechanism 10 in the developer transport direction.

In the lower portion of the development mechanism 10, the unused developer is collected by rotation of the collection screw 13 to the left end portion of the development mechanism 10 in FIG. 4B and then transported to the agitation unit 40 through the tube 30 that communicates with the left end portion of the development mechanism 10.

Then, the developer is supplied from the agitation unit 40 through the tubes 31*a* and 31*b* to the upper portion of the development mechanism 10, where the supply screw 14 supplies the developer to the developer carrier 11 while transporting it in parallel to the axial direction, and thus the toner particles slidingly contact the carrier particles. Accordingly, the charge amount of the toner varies depending on the distance by which the toner is transported by the supply screw 14.

Figure 5:
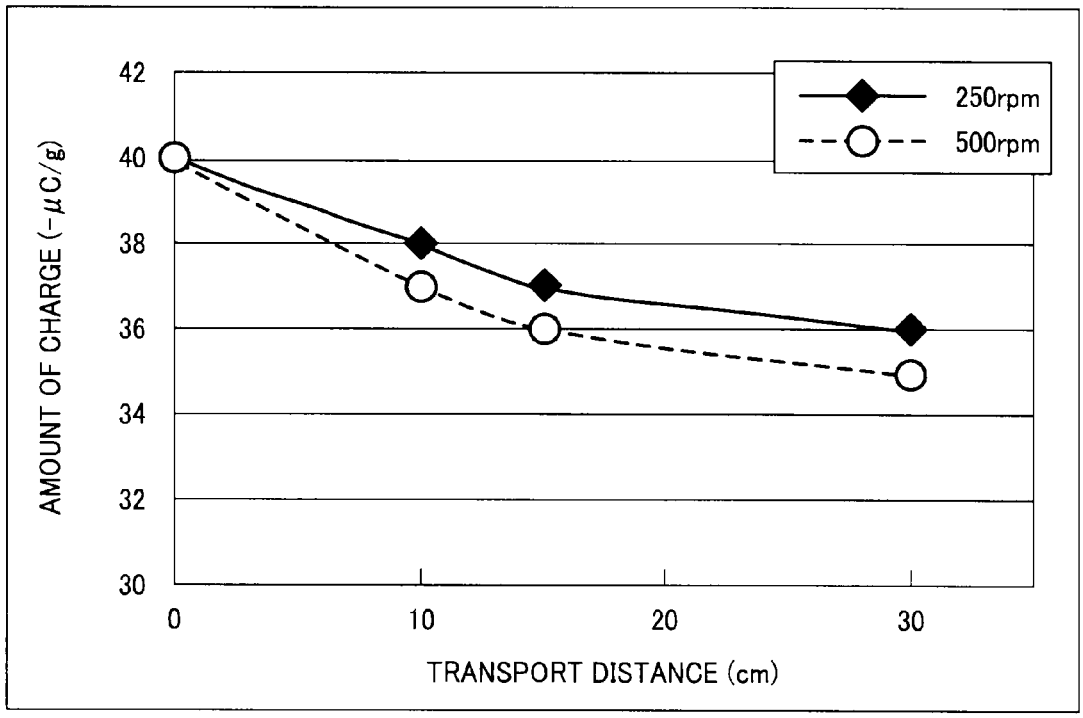
FIG. 5 illustrates a relation between developer charge amount and distance by which the developer is transported by a screw.

FIG. 5 illustrates a relation between the charge amount of toner and the developer transport distance by the screw, obtained from results of an experiment in which the developer was agitated in the agitation unit 40 sufficiently and then supplied to the development mechanism 10.

From the results shown in FIG. 5, it is known that the charge amount of toner (-μC/g) decreases as the rotational velocity (rpm) of the screw as well as the developer transport distance (cm) increase. Even when the charge amount of toner is adjusted in the agitation unit 40 to a degree proper for the development process, the effects of charge amount adjustment is lost if the charge amount decreases while the developer is transported by the screw. To avoid this inconvenience, it is preferred that the developer transport distance by the screw should be shorter.

Regarding the developer transport distance, a development mechanism 10X-1 according to a comparative example is described below with reference to FIG. 6. In the comparative example 1, the developer is supplied through only a single portion, disposed in a left end portion in FIG. 6, to the development mechanism 10-1, and then a supply screw 14-1 supplies the developer to the developer carrier 11X while transporting it along the axial direction. The supply screw 14-1 includes a blade wound around its shaft unidirectionally to transport the developer only toward the right in FIG. 6.

The developer carried on the developer carrier 11X at the right end portion (downstream end portion) in the developer transport direction in the development mechanism 10-1 is transported longer than that carried thereon at the left end portion (upstream end portion) by a distance corresponding to the axial length of the screw 14-1, that is, the difference in the developer transport distance between the developer carried on the developer carrier 11X at the upstream portion and that at the downstream portion corresponds to the axial length of the screw 14-1. Therefore, the charge amount of toner can differ by an amount corresponding to the axial length of the screw 14-1, and the image density differs accordingly between the upstream portion and the downstream portion in the axial direction.

In particular, when the difference in the charge amount is equal to or greater than 5 μC/g, a constant image density cannot be achieved.

By contrast, in the development mechanism 10 according to the present embodiment, the developer that is charged to a desirable level is supplied to the development mechanism 10 through the multiple ports, disposed in both end portions in the axial direction in FIG. 4A, as described above so that the developer transport distance is shorter than that in the comparative example 1. This configuration can reduce the difference in the charge amount of the developer (toner) supplied to the developer carrier 11 between the upstream portion and the downstream portion in the transport direction of the supply screw 14, and thus the image density can be stable.

Additionally, the developer is transported from the agitation unit 40 through the tubes 31*a* and 31*b* by air, which give less stress to the developer, stress to the developer can be smaller. Simultaneously, the diameter of each tube can be smaller by using the multiple developer supply paths, and the components can be arranged more flexibly and accordingly the apparatus can be more compact.

As described above, in the present embodiment, the developer is supplied to multiple portions (e.g., both the left end portion and the right end portion in the transport direction or longitudinal direction of the supply screw 14) of the development mechanism 10, and the multiple openings, namely, the supply ports 61*a* and 61*b*, are formed in the housing 61, in the portions corresponding to the left end portion and the right end portion of the longitudinal direction of the supply screw 14. The tubes 31*a* and 32*b* are connected to the supply ports 61*a* and 61*b*, respectively. The developer that has passed the development region is not immediately supplied again to the developer carrier 11 but is collected, sent to the agitation unit 40 provided separately from the development mechanism 10, and agitated therein before being supplied to the development mechanism 10.

It is to be noted that the blades of the left portion and the right portion of the supply screw 14 are wounded around the shaft in the opposite directions. Therefore, by rotating the entire supply screw 14, that is, both the left portion and the right portion, in an identical direction, the developer supplied to the left end portion as well as that supplied to the right end portion can be transported to the center portion in the axial direction of the supply screw 14. While thus rotating, the supply screw 14 repeatedly supplies the developer to the developer carrier 11 and collects the used developer therefrom simultaneously. As the center portion in the axial direction of the supply screw 14 is a confluence where the developer transported from the left end portion and the right end portion of the supply screw 14 merges together, the opening 20*a* to send the merged developer to the collection screw 13 is formed in the partition 20 to match this confluence.

In the present embodiment, the multiple supply portions are disposed so that the developer supplied through the respective supply portions is transported an identical or similar distance along the supply screw 14. More specifically, in FIG. 4A, the supply ports 61*a* and 61*b* are disposed so that the developer transport distances L1 and L2 respectively transported by the left portion and the right portion of the supply screw 14 are identical or similar, and each of the developer transport distances L1 and L2 is half the axial length of the supply screw 14. In this configuration, the difference in the developer transport distance is minimized.

Figure 6:
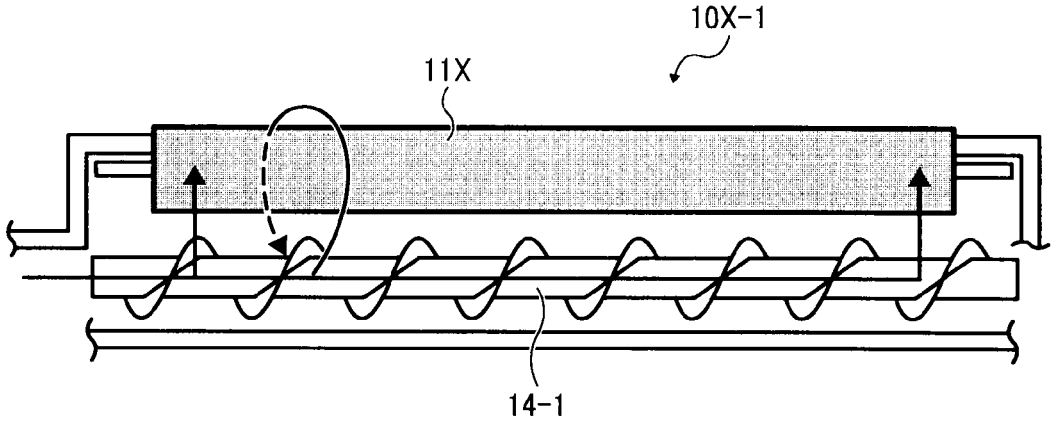
FIG. 6 is a plan view illustrating a development mechanism according to a comparative example.

However, even when the developer transport distances L1 and L2 are not identical, the distance by which the developer is transported by the supply screw 14 can be shorter, and accordingly the difference in the developer transport distance can be smaller, compared with the comparative example shown in FIG. 6.

Although the developer transported in one side portion of the supply screw 14 generally does not enter the other side because the supply screw 14 is configured to transport the developer from both sides to the center portion in the axial direction, the developer can accumulate in the development mechanism 10 when the amount of developer transported to the center portion is excessive. To prevent such developer accumulation, in the present embodiment, the amount by which the developer is supplied (hereinafter "developer supply amount") through the supply ports 61*a* and 61*b* is adjusted by the rotary feeder 50 and the air pump 60 serving as a developer supply amount adjuster.

When the multiple supply portions are disposed so that the developer is transported an identical or similar distance through the respective supply portions, the difference in the charge amount of toner can be minimized.

Additionally, supplying the developer from the multiple portions can attain the following effect. As shown in FIGS. 4A and 6, because the developer transport distance by the supply screw 14 in the present embodiment is half the developer transport distance by the supply screw 14-1 in the comparative example 1, the supply screw 14 can supply the developer across the entire developer carrier 11 in a time period half the time period required for the screw 14-1 to supply the developer across the entire developer carrier 11X in the comparative example 1. In other words, the transport capacity of the supply screw 14 in the present embodiment can be only half the transport capacity of the supply screw 14-1 in the comparative example 1. More specifically, a diameter or rotational velocity of the supply screw 14 shown in FIG. 4A can be half the diameter or rotational velocity of the supply screw 14-1 shown in FIG. 6. Reducing the diameter of the supply screw can make the development mechanism smaller. Reducing the rotational velocity can reduce the stress given to the developer. Additionally, from the results shown in FIG. 5, it can be known that, when the rotational velocity of the supply screw is smaller, the decrease ratio of the toner charge amount to the developer transport distance is smaller.

Thus, by supplying the developer through multiple supply portions to the development mechanism 10 and by reducing the rotational velocity of the supply screw 14, fluctuations in the developer charge amount can be reduced. To confirm these features, experiment 2, described below with reference to FIGS. 11A and 11B, was performed. It is to be noted that, although the number of the supply portions is two, that is, the number of the developer transport paths (tubes 31*a* and 31*b*) from the agitation unit 40 to the development mechanism 10 is two, in the present embodiment, the above-described effect can be increased by increasing the number of the supply portions.

Figure 7:
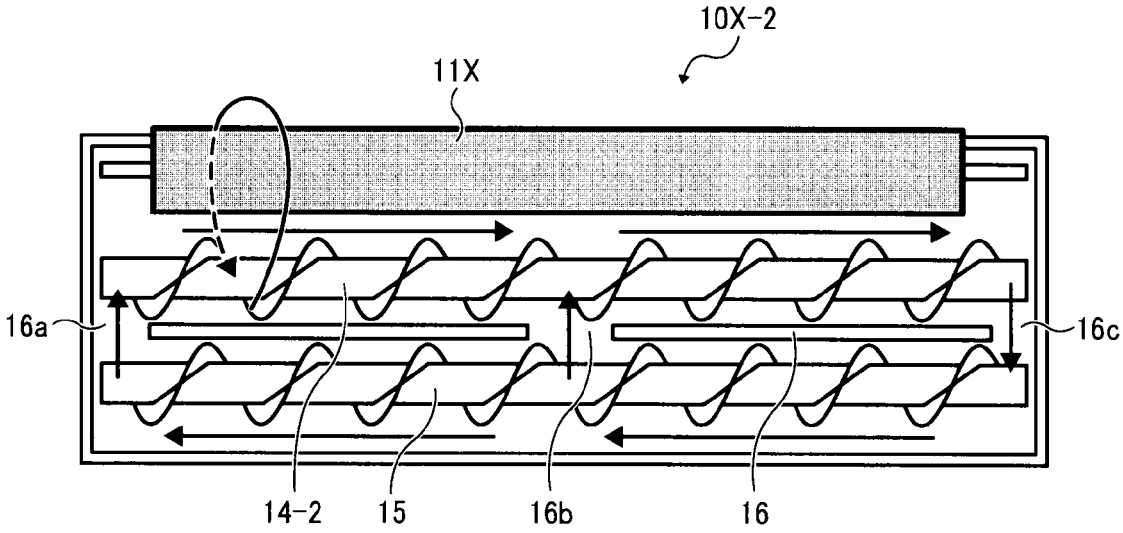
FIG. 7 is a plan view illustrating a development mechanism according to another comparative example.

By contrast, a comparative example 2 shown in FIG. 7 does not include an agitation unit provided separately from a development mechanism 10X-2, and the development mechanisms 10X-2 includes an agitation screw 15 in addition to a supply screw 14-2.

In the comparative development mechanism 10X-2, supply openings 16*a*, 16*b*, and 16*c* are formed in a partition 16 disposed between the supply screw 14-2 and the agitation screw 15. While transporting the developer, the agitation screw 15 agitates the developer so that the developer has a desired charge amount, and then the charged developer flows through multiple developer transport paths and is supplied to the supply screw 14-2 through respective supply openings 16*a*, 16*b*, and 16*c*. Effects similar to those attained in the present embodiment cannot be attained in the comparative example in which the developer is circulated in only the development mechanisms 10X-2 and fresh toner is supplied externally as the toner concentration decreased.

In FIG. 7, for example, the developer whose start point is a right end portion of the supply screw 14-2 can be circulated through two different flow paths in the development mechanism 10X-2: In a first flow path, the developer flows to the left along an arrow shown in FIG. 7, moves to the supply screw 14-2 through the supply opening 16*b* formed in a center portion in a horizontal direction (axial direction) of the partition 16, and then returns to the start point. In a second flow path, the developer flows to a left end portion of the agitation screw 15 along two arrows shown in FIG. 7, moves to the supply screw 14-2 through the supply opening 16*a* formed in a left portion in the horizontal direction of the partition 16, and then returns to the start point. The difference in the developer transport distance between the first and second flow paths corresponds to the length of the screws. Thus, even when the developer is supplied from the agitation screw 15 through the multiple supply portions (supply openings) to the supply screw 14-2, the developer transport distance varies among the multiple flow paths to an extent not to be ignored.

Figure 8:
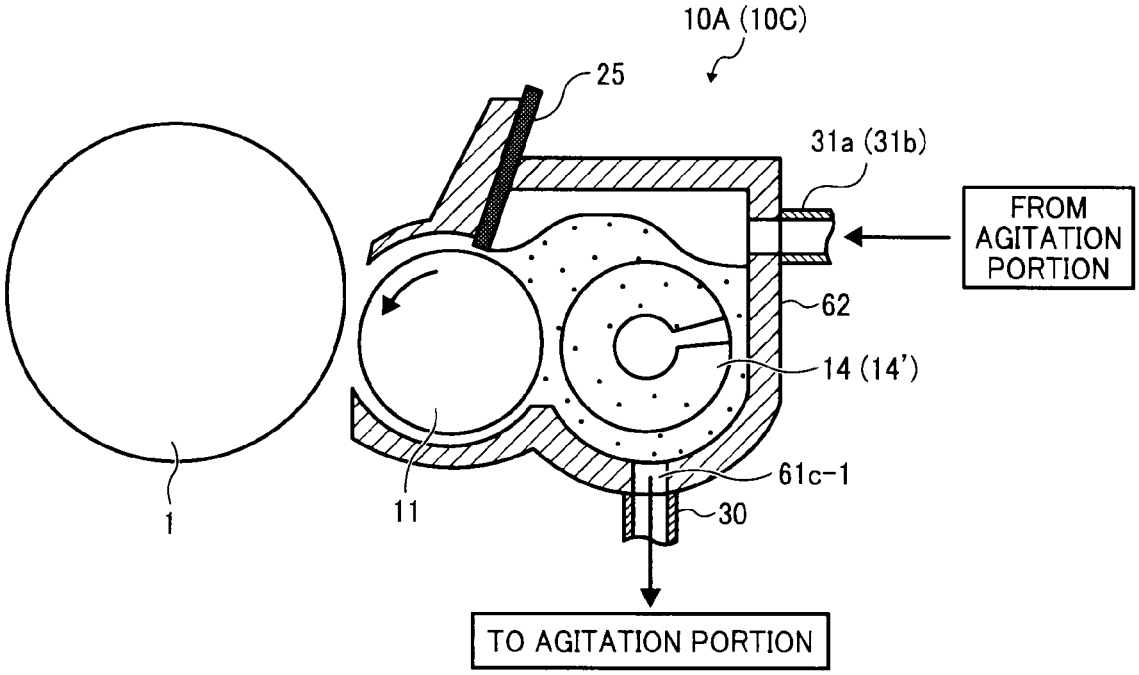
FIG. 8 is a schematic view illustrating a variation of the development mechanism shown in FIGS. 4A and 4B.
Figure 9:
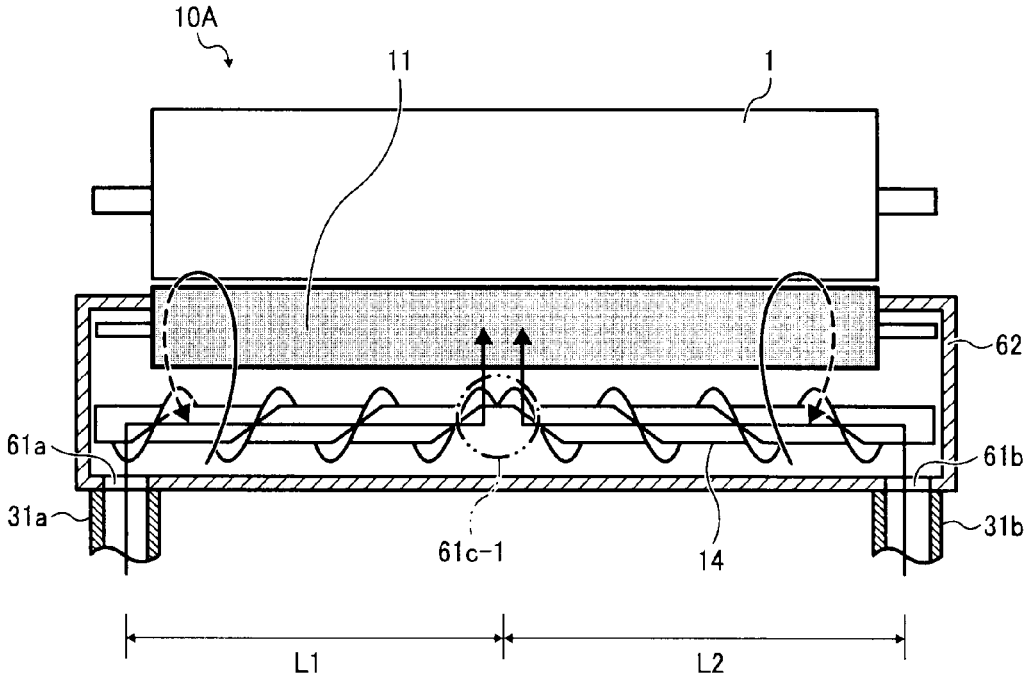
FIG. 9 partially illustrates a cross section of the development mechanism viewed from above in FIG. 8.

A variation of the embodiment shown in FIGS. 3, 4A and 4B is described below with reference to FIGS. 8 and 9. FIG. 8 illustrates a cross section of a development mechanism 10A perpendicular to the axial direction of the developer carrier 11, and FIG. 9 is illustrates a cross section of the development mechanism 10A partially, viewed from above.

In the development mechanism 10A according to the present variation the developer is supplied through the both end portions in the axial direction of the supply screw 14 similarly to the embodiment shown in FIGS. 3, 4A and 4B. However, the development mechanism 10A is different from the embodiment shown in FIGS. 4A and 4B in that the collection screw 13 as well as the partition 20 are not provided, and that a single screw (supply screw 14) performs both supplying the developer to the developer carrier 11 and collecting the developer therefrom. That is, the supply screw 14 serves as a developer transport member that supplies the developer to the developer carrier 11 and collects the developer therefrom while transporting the developer in parallel to the axial direction of the developer carrier 11.

In a housing 62 of the development mechanism 10A, a supply screw 14, a developer carrier 11, and a doctor 25 are provided similarly to the development mechanism 10 shown in FIGS. 3, 4A and 4B, and a blade of the supply screw 14 wound around its shaft in opposite directions on both sides of a center portion in the longitudinal direction. As shown in FIG. 9, openings 61*a* and 61*b* are formed in the housing 62 to match the left and right end portions of the longitudinal direction of the supply screw 14, and the tubes 31*a* and 31*b* are connected to the openings 61*a* and 61*b*, respectively. The developer that have passed the development region flows to the tube 30 (shown in FIG. 8) through a discharge port 61*c*-1 disposed to correspond to the center portion in the longitudinal direction of the supply screw 14, and then the developer is collected in the agitation unit 40. In the present variation, the developer transport distances L1 and L2 respectively transported by the left portion and the right portion of the supply screw 14 are half the axial length of the supply screw 14 and identical or similar. Differences in the developer transport distance can be smallest in this configuration.

Thus, the development mechanism 10A according to the present variation can achieve effects similar to those attained in the embodiment shown in FIGS. 3, 4A and 4B. Because the number of the screws used in the development mechanism 10A is smaller, the development mechanism 10A can be compact accordingly.

A development mechanism 10B according to another embodiment is described below with reference to FIGS. 10, 11A, and 11B.

Figure 10:
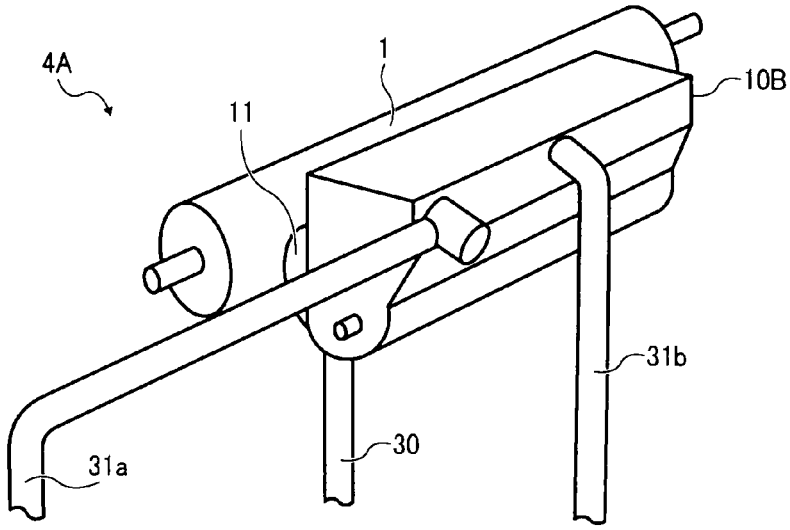
FIG. 10 is a perspective view illustrating a development mechanism according to another illustrative embodiment.

FIG. 10 is a perspective view illustrating an exterior of a development device 4A including the development mechanism 10B. FIGS. 11A and 11B respectively correspond to FIGS. 4A and 4B and partially illustrate a cross section of the development mechanism 10B viewed from above and a cross section of a lower portion of the development mechanism 10B viewed from a side.

It is to be noted that the development device 4A has a configuration similar to that of the development device 4 shown in FIG. 2, and the toner bottle 22, the agitation unit 40, the rotary feeder 50, the air pump 60 and the like, connected to the tubes 30, 31*a*, and 31*b* are omitted in FIG. 10 for simplicity. A diagram illustrating a cross section of the development mechanism 10B perpendicular to the axial direction of the developer carrier 11 is similar to that shown in FIG. 3 and thus omitted.

Figure 11A:
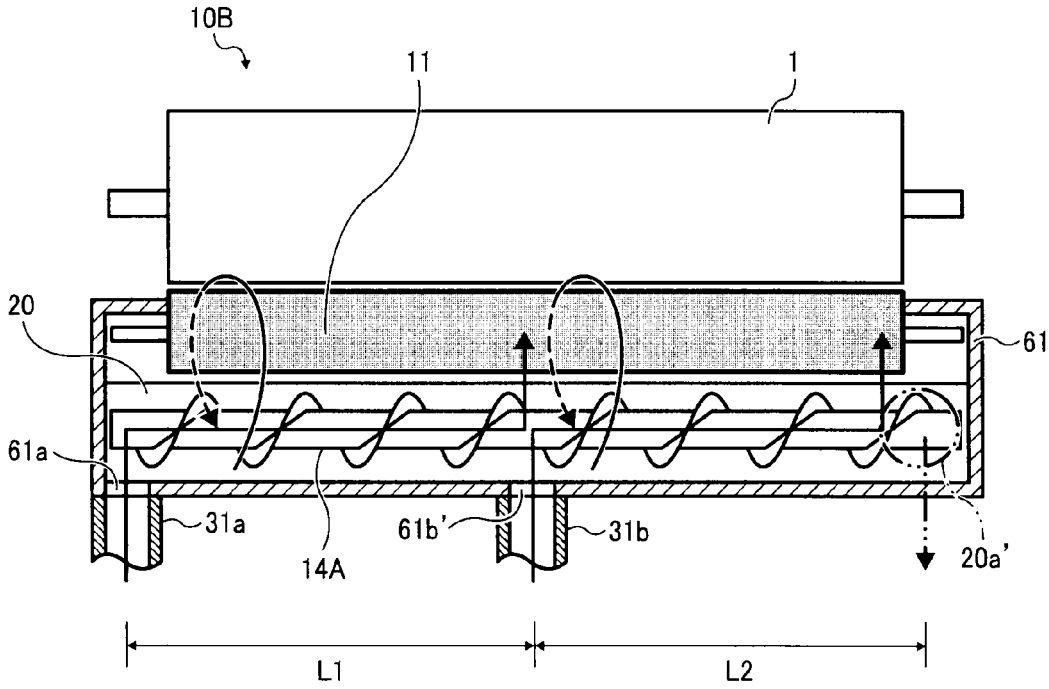
FIG. 11A partially illustrates a cross section of the development mechanism shown in FIG. 10 viewed from above.
Figure 11B:
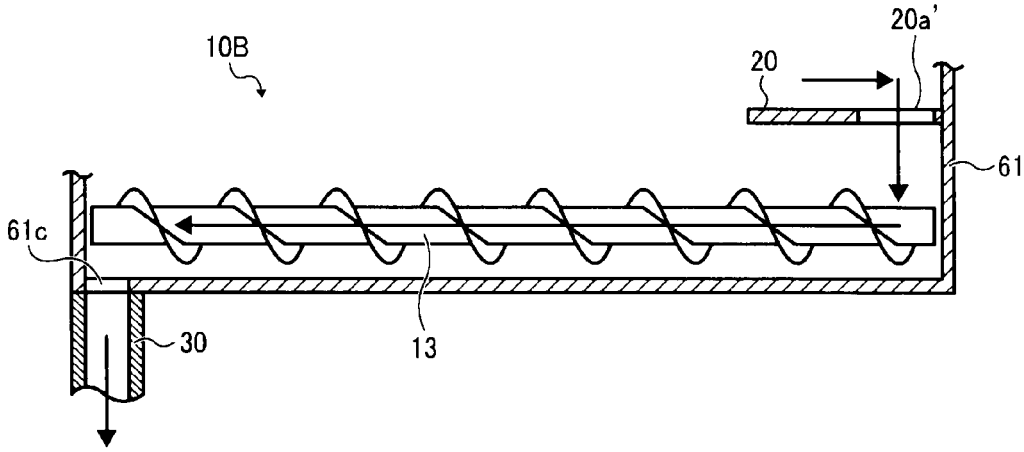
FIG. 11B illustrates a cross section of a lower portion of the development mechanism shown in FIG. 10 viewed from a side.

The development mechanism 10B shown in FIGS. 10, 11A, and 11B has a specific feature in that supply portions (supply ports) are provided in an end portion as well as a center portion in the axial direction of a supply screw 14A. The position and the connection of the development mechanism 10B in the development device 4 shown in FIG. 2 is different in that the tube 31*b* leading from the agitation unit 40 is connected to the center portion of the development mechanism 10B in the longitudinal direction as shown in FIG. 10. The supply screw 14A and a collection screw 13 together form a developer transport member that supplies and collects the developer from the developer carrier 11 while transporting the developer in the development mechanism 10B in parallel to a axial direction of the developer carrier 11.

As shown in FIG. 11A, differently from the supply screw 14 shown in FIG. 4A, the blade of the entire supply screw 14A is unidirectionally wound around its shaft, and thus the supply screw 14A transports the developer only from left to right in FIG. 11A unidirectionally. Although the opening 61*a* (supply port) to which the tube 31*a* is connected is disposed in a left end portion of the development mechanism 10B similarly to the configuration shown in FIG. 4A, the opening 61*b*' (supply port) to which the tube 31*b* is connected is disposed in the center portion in the longitudinal direction of the supply screw 14A. Additionally, as shown in FIG. 11A, an opening 20*a*' through which the developer flows to the collection screw 13 is formed in a right end portion of a partition 20, which corresponds to a downstream end of the developer transported by the supply screw 14A.

Except those features, the development mechanism 10B has a similar configuration and operates similarly to those in the embodiment shown in FIGS. 2 through 4B. Thus, also in the present embodiment, the tube 30 communicates with the discharge port 61*c* formed in the left end portion of the development mechanism 10B, which corresponds to a downstream end of the developer transported by the collection screw 13.

In the present embodiment, the developer is supplied to the development mechanism 10B through both the left end portion and the center portion in the longitudinal direction of the development mechanism 10B. As shown in FIG. 11A, the developer supplied through the left end portion (61*a*) and the center portion (61*b*') transported the developer transport distances L1 and L2, respectively, which are shorter than the developer transport distance in the comparative example 1 shown in FIG. 6. When the supply port 61*b*' is thus disposed in the center portion in the axial direction of the supply screw 14A, the developer transport distances L1 and L2 are identical or similar and half the axial length of the supply screw 14A. In this configuration, the difference in the developer transport distance is minimized, and accordingly the difference in the charge amount of toner supplied to the developer carrier 11 can be smaller and half the difference in the toner charge amount in the comparative example shown in FIG. 6.

Also in the present embodiment, the developer is agitated in the agitation unit 40 provided separately from the development mechanism 10B, supplied from the agitation unit 40 through the tubes 31*a* and 31*b* by air, which gives less stress to the developer, and then supplied to the upper portion of the development mechanism 10B through multiple supply portions, namely, the supply port 61*a* disposed in the left end portion and the supply port 61*b*' disposed in the center portion in the transport direction (longitudinal direction) of the supply screw 14A. In the upper portion of the development mechanism 10B, while transporting the developer from left to right in FIG. 11A in parallel to the axial direction in both the left and right portions, the supply screw 14A repeatedly supplies the developer to the developer carrier 11 and collects the used developer therefrom simultaneously.

It is not desirable that the amount of the developer transported in the left portion is excessive, and the developer transported from the left portion enters the right portion and is then supplied to the developer carrier 11. Also, it is not desirable that the amount of the developer supplied through the supply opening 61*b*' and is then transported in the right portion exceeds the discharge capacity of the opening 20*a*' because the developer accumulates in the development mechanism 10B in such a case. Therefore, the amount by which the developer is supplied through the supply ports 61*a* and 61*b*' is adjusted also in the present embodiment.

A variation of the embodiment shown in FIGS. 10 through 11B is described below with reference to FIG. 12 that illustrates a cross section of a development mechanism 10C partially, viewed from above. It is to be noted that a cross section of the development mechanism 10C perpendicular to the axial direction of the developer carrier 11 is similar to that shown in FIG. 8.

Figure 12:
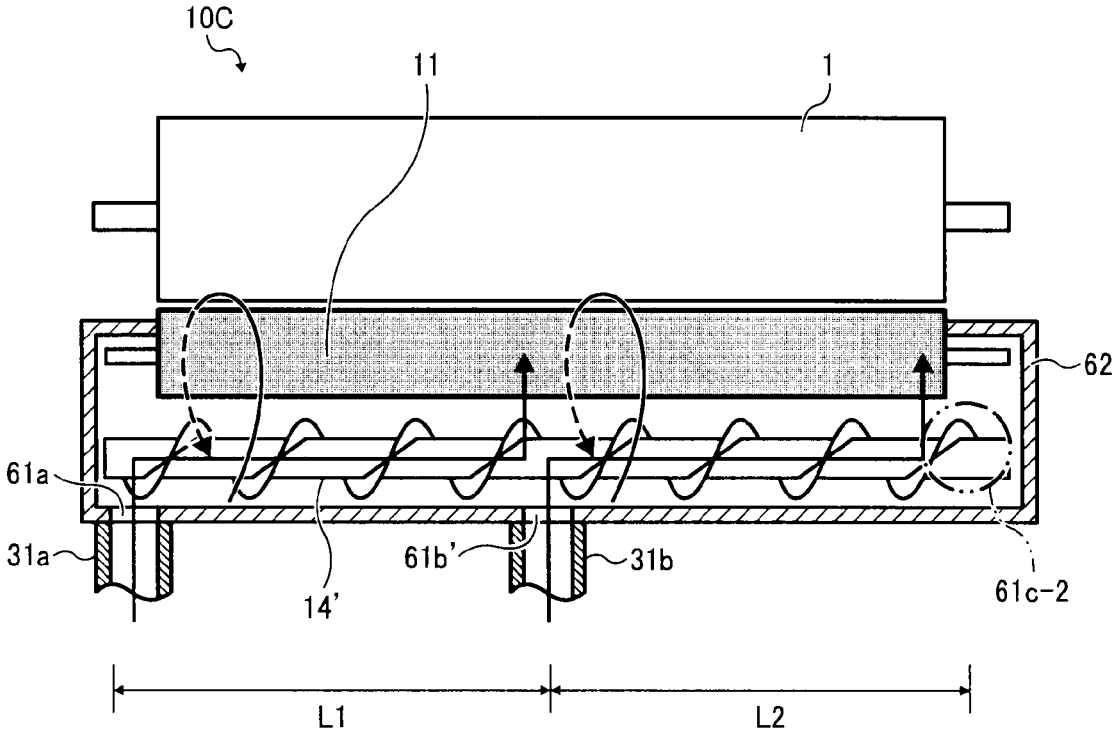
FIG. 12 partially illustrates a cross section of a development mechanism according to a variation of the development mechanism shown in FIGS. 10, 11A and 11B, viewed from above.

The development mechanism 10C shown in FIG. 12 is a variation of the embodiment (development mechanism 10B) shown in FIGS. 10 through 11B, and the supply portions (supply ports 61*a* and 61*b*') are disposed in the left end portion and the center portion in the axial direction of the supply screw 14A' similarly to the embodiment shown in FIGS. 10 through 11B. However, the development mechanism 10C is different from the development mechanism 10B shown in FIGS. 11A and 11B in that the partition 20 as well as the collection screw 13 are not provided, and a single screw (supply screw 14A') performs both supplying the developer to the developer carrier 11 and collecting the developer therefrom. That is, the supply screw 14A' serves as a developer transport member that supplies and collects the developer from the developer carrier 11 while transporting the developer in the development mechanism 10C in parallel to a axial direction of the developer carrier 11.

Additionally, a discharge port 61*c*-2, where the tube 30 is connected to the development mechanism 10C, is disposed on the opposite side in the longitudinal direction from that in the development mechanism 10B shown FIG. 11B.

Except the above-described features, the development mechanism 10C has a similar configuration and operates similarly to those in the embodiment shown in FIGS. 11A and 11B. The position and the connection of the development mechanism 10C in the development device 4 shown in FIG. 2 are similar to the configuration shown in FIG. 2 except the connecting position of the tube 30.

A substantial amount of the developer supplied through the opening 61*a* is consumed in the development process while transported in the left portion, and the developer supplied through the opening 61*b*' is consumed in the development process while transported in the right portion in the development mechanism 10C. Then, developer flows from an opening formed in the housing 62, in a portion corresponding to a right end portion of the supply screw 14A', to the tube 30, and then collected in the agitation unit 40 shown in FIG. 2.

Also in this variation, the developer transport distances L1 and L2 are identical or similar and half the axial length of the supply screw 14A', and thus, the development mechanism 10C can achieve effects similar to those attained in the embodiment shown in FIGS. 11A and 11B. Additionally, because the number of the screws used in the development mechanism 10A is smaller, the development mechanism 10A can be compact accordingly.

(Agitation Unit)

Next, the agitation unit 40 is described below with reference to FIG. 13.

The agitation unit 40 includes a cylindrical container 41 extending vertically, and the screw 42 is disposed in an axial center portion of the container 41. The screw 42 is connected to a rotary shaft 45*a* of the motor 45, and the rotary blade 43 to agitate the developer is attached to the rotary shaft 45*a* loosely enough to rotate. A first drive gear G1 is fixed on the rotary shaft 45*a* and engages a first intermediate gear G2. The first intermediate gear G2 is fixed to an intermediate shaft 46 that is supported by a frame 44 as well as the container 41. A second intermediate gear G3 is also fixed to the intermediate shaft 46 and engages a second drive gear G4. The second drive gear G4 engages the rotary shaft 45*a* loosely enough to rotate, is rotatable relative to the first drive gear G1, and is formed on the rotary blade 43 as single unit.

When the motor 45 rotates, the screw 42 connected to the motor 45 rotates. Simultaneously, this rotation is sequentially transmitted to the first drive gear G1, the second intermediate gear G2, the second intermediate gear G3, and the second drive gear G4, and thus the rotary blade 43 rotates at a rotational velocity different from that of the screw 42. Rotation of the screw 42 transports the developer in the container 41 upward. The rotary blade 43 rotates around the screw 42 along an inner surface of the container 41. An opening through which the toner is sent from the toner supply tube 21 is formed in a side wall of the container 41, and an opening 41*a* communicating with the tube 30 is formed in an upper portion of the container 41.

Thus, the toner supplied through the toner supply tube 21 enters the container 41 from its side, and the developer collected from the development mechanism 10, 10A, 10B, or 10C (hereinafter collectively "development mechanism 10") through the tube 30 enters the container 41 from above. While the rotary blade 43 mixes together the supplied toner and the collected developer, the screw 42 transports the mixture upward, which generates convention, and the supplied toner and the collected developer are agitated three-dimensionally. Thus, the fresh toner supplied from the toner bottle 22 (shown in FIG. 2) and the developer connected from the development mechanism 10 are mixed so that the developer in the agitation unit 40 has a desired toner concentration and is charged to a desired level. Then, the developer is sent to the rotary feeder 50 through an outlet 47 formed in a bottom portion of the container 41.

(Rotary Feeder and Air Pump)

Figure 14:
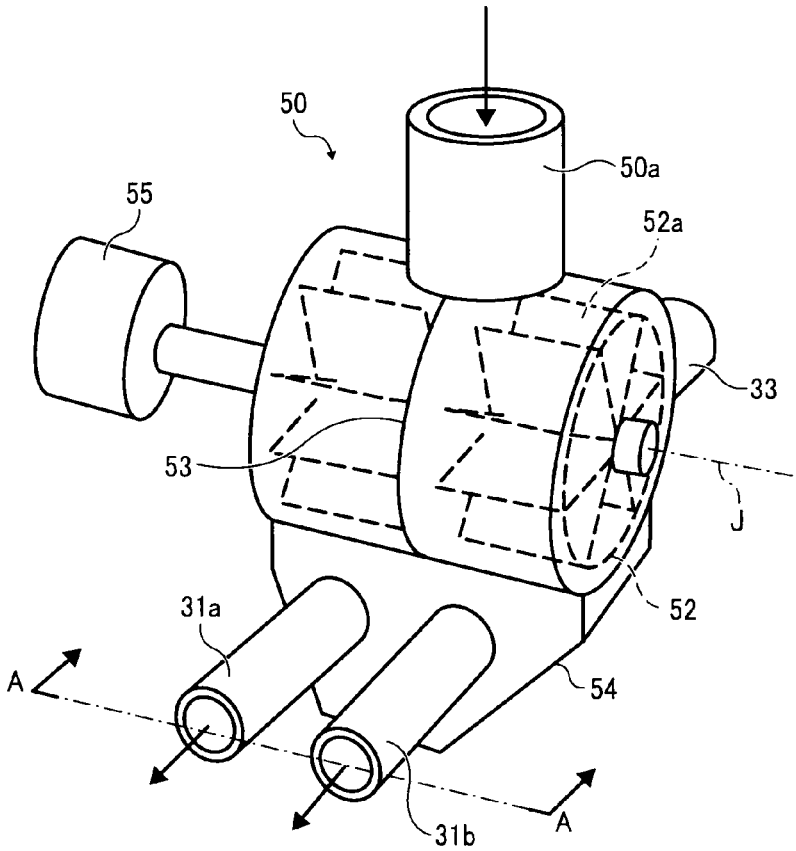
FIG. 14 illustrates a configuration around a rotary feeder.

FIG. 14 is an enlarged view illustrating the rotary feeder 50 and components disposed around the rotary feeder 50. In FIG. 14, reference character J represents a rotational axial line or axial direction of the rotary feeder 50, and 53 represents a partition dividing the rotary feeder 50 into two.

Figure 13:
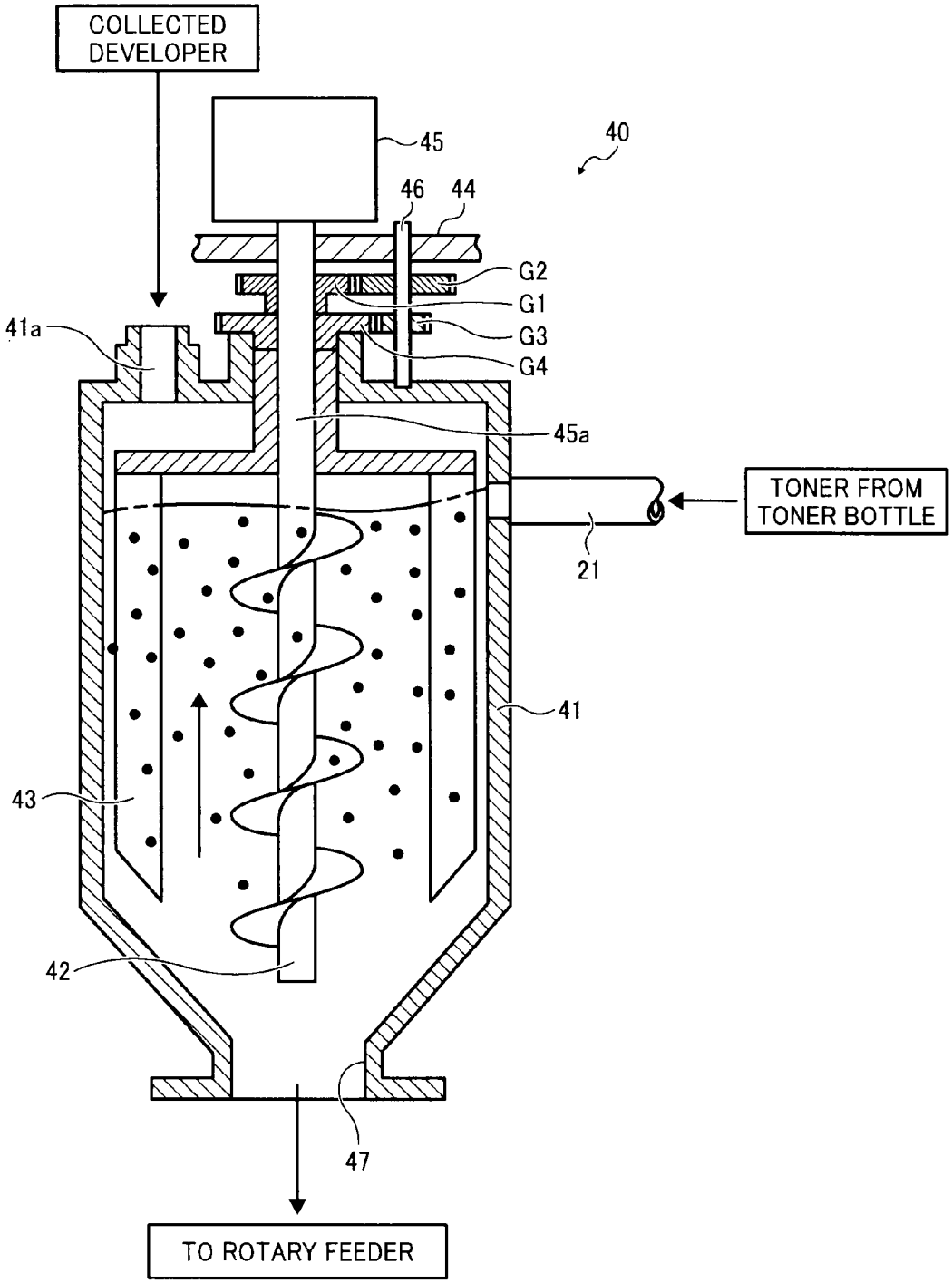
FIG. 13 illustrates a cross section of an agitation unit according to an illustrative embodiment.

The rotary feeder 50 shown in FIG. 2 is connected to the outlet 47 shown in FIG. 13 of the agitation unit 40 via a communication tube 50*a* shown in FIG. 14.

Referring to FIG. 14, the communication tube 50*a* disposed above the rotary feeder 50 is connected to the outlet 47 of the agitation unit 40. In the configuration shown in FIG. 14, the communication tube 50*a*, the rotary feeder 50, and the discharge space 54 together form a discharge unit into which the developer is discharged from the agitation unit 40 shown in FIG. 2.

Two rotors 52 are provided in the rotary feeder 50, and each rotor 52 includes multiple blades 52*a* arranged around the axial line of the rotary feeder 50. Because two rotors 52 are disposed on both sides of the partition 53 in the rotary feeder 50 in the present embodiment, the length of each rotor 52 in the axial direction is half the length the original length, that is, the length of a rotor when only a single rotor is provided in the rotary feeder 50. By rotating the rotors 52 with the motor 55, a predetermined or given amount of developer is discharged from the agitation unit 40, disposed upstream from the rotary feeder 50 in the developer circulation direction, to the discharge space 54 disposed beneath the rotary feeder 50. Thus, the rotary feeder 50 serves as a developer transport member to transport the developer from the agitation unit 40 to the discharge space 54.

The connections of the tubes 33, 31*a*, and 31*b* to the discharge space 54 are described below with reference to FIGS. 15 and 16, which illustrate an A-A cross section shown in FIG. 14 of the discharge space 54, and a cross section of the rotary feeder 50 and components around the rotary feeder 50.

The discharge space 54 is a box-like chamber connected to a bottom portion of the rotary feeder 50, and a partition 54*a* divides an interior of the discharge space 54 into two divided chambers 54B. As shown in FIGS. 15 and 16, two air inlets 54C through which air from the air pump 60 flows in are formed in a first wall (first side) 54F of the discharge space 54 and respectively communicate with the bifurcated tubes 33A and 33B of the tube 33 through which air is sent by the air pump 60. Two openings 54D respectively communicating with the tubes 31*a* and 31*b* are formed in a second wall (second side) 54E facing the first wall 54F in which the two air inlets 54C are formed to match the positions of the respective air inlets 54C. As shown in FIGS. 14, 15, and 16, when viewed from above, the direction of the air (hereinafter "airflow direction") flowing in the discharge space 54 is perpendicular to the axial line J.

It is to be noted that, although multiple air inlets 54C are formed in the first wall 54F in the configuration shown in FIG. 15, the air from a single pump may enter through a single air inlet. In such case, the discharge space 54 may include no partition dividing the discharge space 54, and the developer may be divided when discharged by the air from the air pump 60 from the discharge space 54. Alternatively, the discharge space 54 may be partially divided by a partition.

Figure 17A:
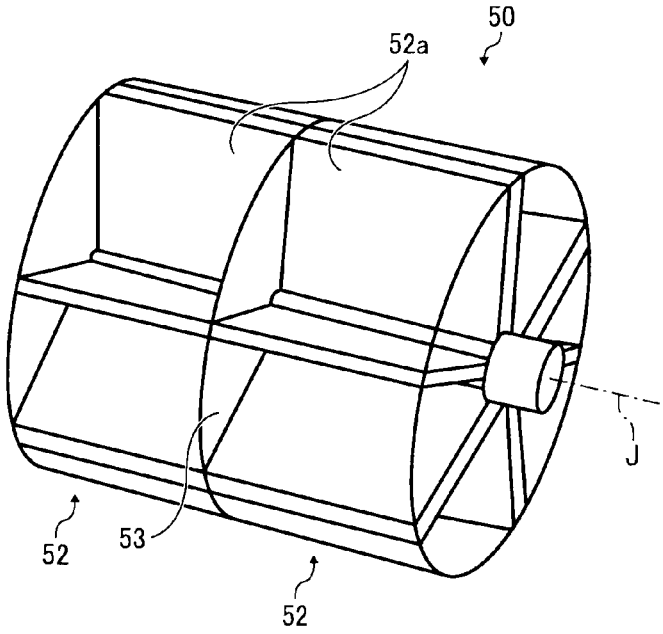
FIGS. 17A and 17B are respectively a perspective view of rotors included in the rotary feeder shown in FIG. 14 and an end-on cross-section from an axial of the rotors.
Figure 17B:
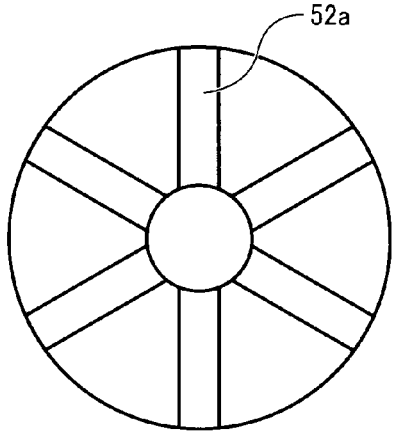

FIG. 17A is a perspective view of the rotors 52, and FIG. 17B illustrates an end-on cross-section of the rotor 52 viewed from an axial end.

The air pumped out by the air pump 60 flows through the tube 33 to the discharge space 54 and then transports the developer discharged by the rotary feeder 50 to the development mechanism 10 through the respective openings formed in the discharge space 54 and the respective tubes 31*a* and 31*b*. Thus, the developer discharged by the rotary feeder 50 and the air pumped out by the air pump 60 are mixed together in the discharge space 54 disposed beneath the rotary feeder 50.

In the various embodiments described above, because the developer is supplied to the development mechanism through the multiple supply portions, the developer should be transported through multiple different developer transport paths.

More specifically, the two rotors 52 each having half the original length in the axial direction J are fixed on both sides of the partition 53, thus forming a single unit. Accordingly, as shown in FIG. 15, the discharge space 54 is divided into the two divided chambers 54B by the partition 54*a* in the direction in which the rotary feeder 50 is divided. Thus, air is sent to each divided chamber 54B, and the developer flows from the rotary feeder 50 to the respective divided chambers 54B.

The developer agitated in the agitation unit 40 is divided when entering the rotary feeder 50, and each rotor 52 sends the developer to each divided chamber 54B, after which the developer is transported to the development mechanism 10 through multiple developer transport paths, that is, tubes 31*a* and 31*b*, whose number corresponds to the number of the divided chambers 54B.

(Developer Supply Amount Adjuster)

Figure 22:
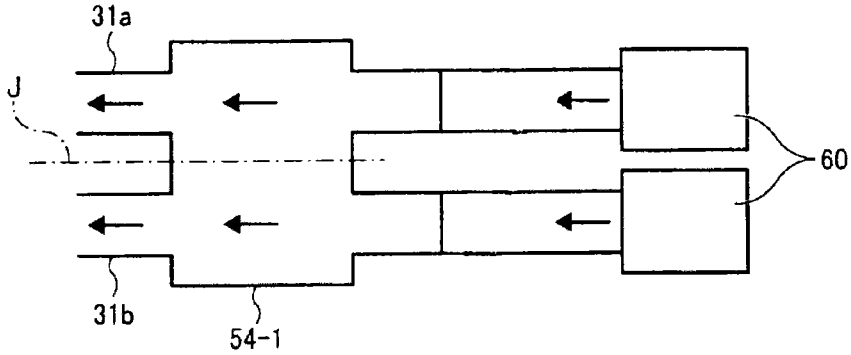
FIG. 22 illustrates a configuration in which individual air pumps are used to supply an airflow to each of multiple developer transport paths.

To transport the developer through the multiple different developer transport paths (tubes 31*a* and 31*b*), as shown in FIG. 15, a single air pump (60) can be used and the airflow path leading from the single air pump 60 can be divided (bifurcated tubes 33A and 33B). Alternatively, as shown in FIG. 22, multiple air pumps 60 may be used to generate multiple airflows for the respective developer transport paths. In this case, each air pump 60 can serve as an individual airflow supplying member to generate individual airflows for or supply individual airflows to the respective developer transport paths, and the respective pumps together form an airflow generating system to generate the airflow to transport the developer through the multiple developer transport paths. Because the amount of air output from each air pump 60 can be controlled separately, using these multiple individual air pumps 60 can facilitate adjusting the amount of the developer supplied through the respective paths when the balance of the developer supplied through the multiple developer transport paths fluctuates. Thus, the developer can be divided equally among the multiple developer transport paths. As described above, the developer supply amount is determined by the rotational velocity of the rotary feeder 50 and the amount of air pumped by the air pump 60. By contrast, when only a single air pump is used, the amount of the developer supplied through the respective developer transport paths may be adjusted separately by controlling the rotors 52 separately.

Thus, with the rotary feeder 50 and the air pump 60, together forming the developer supply amount adjuster, the developer can be divided equally among the multiple develop transport paths and the developer supply amount through them can be adjusted. Accordingly, the developer can be transported smoothly, and clogging in a downstream end portion of each developer transport path in the developer circulation direction can be prevented. The air pump 60 serves as an airflow generator to generate and supply airflow to the developer transport paths. Additionally, the above-described individual air pumps; or the single air pump and the partition 54*a* serve as an individual airflow supplying member to generate individual airflows for or supply individual airflows to the respective developer transport paths and contribute to maintaining a constant developer supply amount.

Figure 18A:
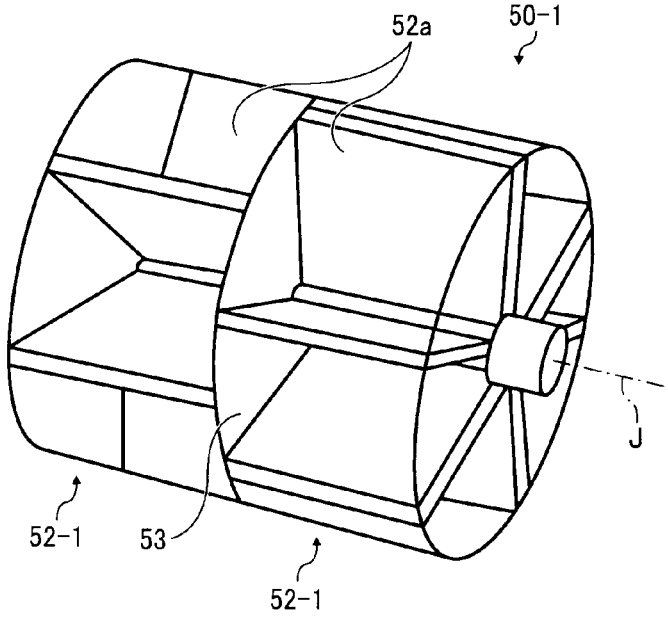
FIGS. 18A and 18B are a perspective view of rotors according to another illustrative embodiment and an end-on cross-section of the rotors viewed from an axial end.
Figure 18B:
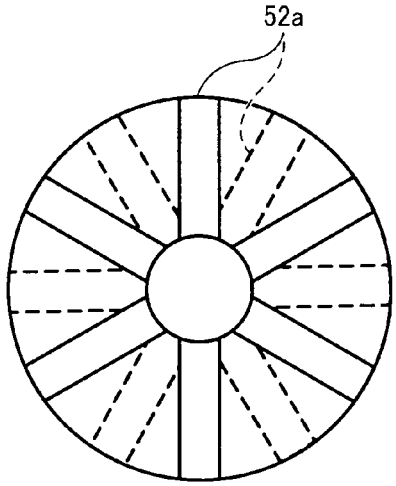

It is to be noted that the angle, that is, the phase relative to the axial direction, of the blades 52*a* of the rotors 52 respectively disposed on the right and left of the partition 53 in FIG. 17A are not necessarily identical as in the configuration shown in FIGS. 17A and 17B. Alternatively, a rotary feeder 50-1 shown in FIGS. 18A and 18B is formed by two rotors 52-1 whose blades 52*a* are angled at different angles as shown in FIG. 18A, which can reduce the load to the air pump 60 because the developer can drop alternately onto the right and the left rotors 52-1.

(Relative Positions of Rotary Feeder and Developer Flow Direction)

Figure 19:
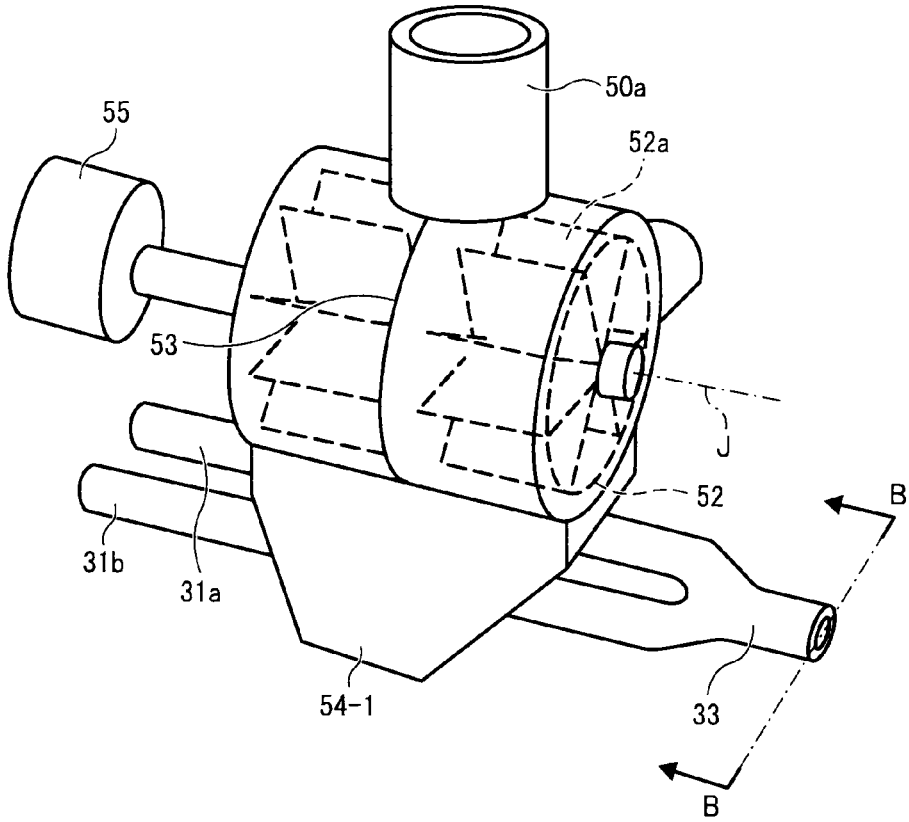
FIG. 19 illustrates a configuration around a rotary feeder according to another embodiment.
Figure 20:
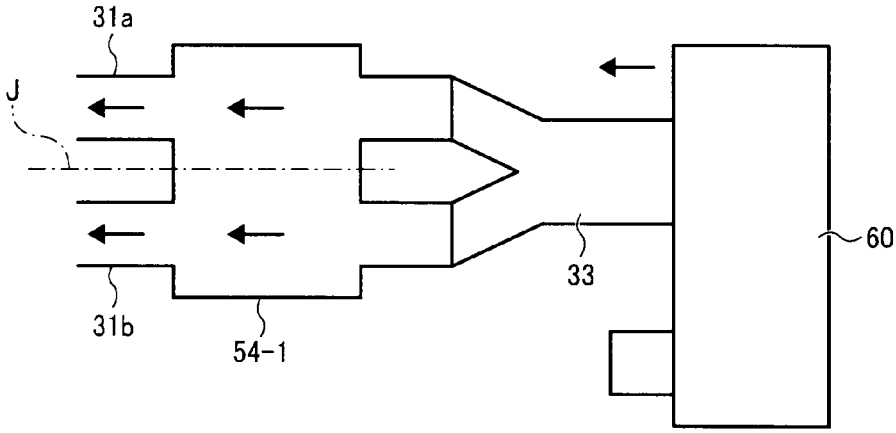
FIG. 20 is a cross section of the configuration shown in FIG. 19 indicated by arrow B-B shown in FIG. 19.
Figure 21:
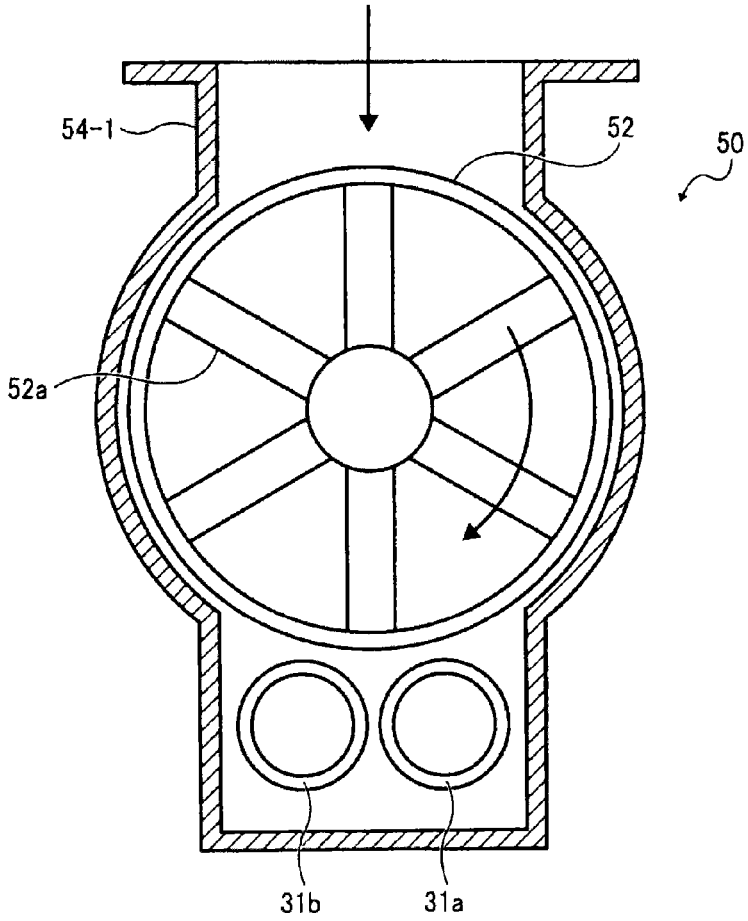
FIG. 21 illustrates another cross section of the configuration shown in FIG. 19.

As described above, in the configuration shown in FIGS. 14, 15, and 16, the airflow direction in the discharge space 54 is perpendicular to the axial line J of the rotors 52 when viewed from above. Alternatively, as shown in FIGS. 19, 20, and 21, respectively corresponding to FIGS. 14, 15, and 16, the airflow direction in a discharge space 54-1 may be in parallel to the axial line J of the rotors 52 when viewed from above.

Figure 16:
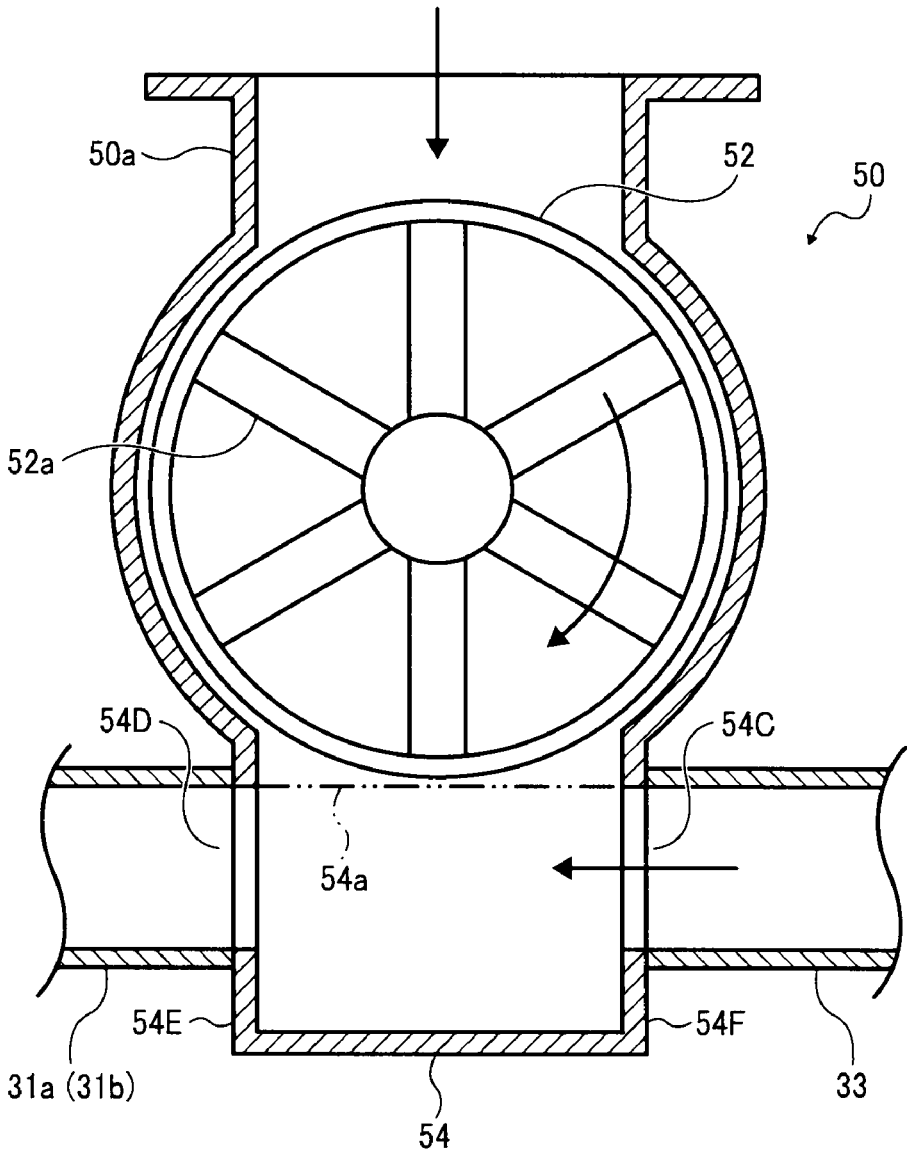
FIG. 16 illustrates another cross section of the configuration around the rotary feeder shown in FIG. 14.

In the configuration shown in FIGS. 14 through 16, the developer can be divided equally into the respective divided chambers 54B by dividing the discharge space 54 in parallel to the airflow direction therein with the partition 54*a* because the airflow direction matches the rotational direction of the rotors 52. By contrast, in the configuration shown in FIGS. 19 through 21, the amount of the developer discharged in the discharge space 54-1 is greater in an upstream portion in the rotational direction of the rotors 52 than in a downstream portion even if the discharge space 54 is divided in parallel to the airflow direction therein with a partition, because this direction is perpendicular to the rotational direction of the rotors 52. Thus, the developer cannot be divided equally into the respective divided chambers.

Therefore, in the discharge space 54-1, the flow of the developer is not divided by a partition but by the divided airflows.

It is preferable that the developer should be divided when the developer moves at a smaller velocity. Because the developer is transported by air at a higher velocity in the tubes 31*a* and 31*b*, it is preferred that the developer be divided upstream from the tubes 31*a* or 31*b* in the developer circulation direction. If the developer is divided immediately before the developer is supplied to the development mechanism 10, the developer might hit the partition or the like dividing the developer, thus receiving stress. Therefore, it is preferable that the developer be divided after being agitated before being transported by air as in the present embodiment. Additionally, in the configuration in which the developer is divided after being agitated before being transported by air, each tube forming the sub-path can be thinner because the developer transport path is divided. Thus, the tube can be disposed in a smaller space between the components, which can enhance design flexibility. It is preferred that the tubes 31*a* and 31*b*, each of which forms the sub-path downstream from where the developer is divided in the developer circulation direction, have identical length because time lag is caused in the arrival time of the developer at the developer carrier 11 if the distance between the sub-paths differs significantly. Additionally, each developer transport path should have only a necessary length. If the developer transport path is excessively long, the developer may be charged by air unnecessarily while transported by air, which means that the charge amount of the developer varies from the amount adjusted in the agitation unit 40.

(Experiments)

To measure the charge amount of the developer carried on the developer carrier 11, experiments were performed using a development mechanism having a configuration similar to that of the development mechanism 10 shown in FIGS. 3, 4A and 4B and including a developer carrier 11 having a diameter of 18 mm and a length of 300 mm; a supply screw 14 having a diameter of 14 mm and a double pitch of 20 mm; and a collection screw 13 having a diameter of 14 mm and a single pitch of 20 mm. The developer carrier 11 and the collection screw 13 were rotated at rotational velocities of 300 rpm and 500 rpm, respectively. It is to be noted that the charge amount of the developer after being agitated in the agitation unit 40 was −40 μC/g.

The developer was supplied through both the left and right end portions in the longitudinal direction to the development mechanism 10 as shown in FIG. 4A.

(Experiment 1)

In experiment 1, the supply screw 14 was rotated at a rotational velocity of 500 rpm. The developer carried on the left end portion as well as that carried on the center portion of the developer carrier 11 were sampled; the charge amounts of them were respectively −40 μC/g and −36 μC/g, that is, the difference in the developer charge amount between the left end portion and the center portion was 4 μC/g.

(Experiment 2)

In experiment 2, the supply screw 14 was rotated at a rotational velocity of 250 rpm. Similarly, the developer carried on the left end portion as well as that carried on the center portion of the developer carrier 11 were sampled; the charge amounts of them were respectively −40 μC/g and −37 μC/g. That is, the difference in the developer charge amount between the left end portion and the center portion of the developer carrier 11 was 3 μC/g.

The difference in the developer charge amount was reduced from the experiment 1 by reducing the rotational velocity of the supply screw 14.

(Comparative Experiment)

As a comparative experiment, the developer was supplied while rotating the supply screw 14-1 at a rotational velocity of 500 rpm in the configuration according to the comparative example shown in FIG. 6.

The developer carried on the left end portion (upstream end) as well as that carried on the right portion (downstream end) of the developer carrier 11X were sampled; the charge amounts of them were respectively −40 μC/g and −35 μC/g. From the above-described results of the experiments 1 and 2; and the comparative experiment, it is known that the difference in the developer charge amount is smaller in the embodiment shown in FIG. 4A than in the comparative example shown in FIG. 6.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a development mechanism, including multiple supply ports through which developer is supplied to the development mechanism, a discharge port through which the developer is discharged from the development mechanism, a developer carrier to carry the developer to develop a latent image, a developer supply member extending in a direction parallel to the axial direction of the developer carrier, to supply the developer to the developer carrier while transporting the developer in the direction parallel to the axial direction of the developer carrier, and a developer collection member disposed in parallel to the developer supply member, to collect the developer from the developer carrier;

an agitation unit connected to the development mechanism, to agitate and mix together developer collected from the development mechanism and fresh toner; and a transport member to transport the agitated developer from the agitation unit to the multiple supply ports provided in the development mechanism through a developer transport path, wherein the multiple supply ports are disposed at different positions in the development mechanism in the axial direction of the developer carrier.

2. The development device according to claim 1, wherein the developer transport path comprises a tube and is divided into multiple sub-paths each connected to a respective one of the multiple supply ports provided in the development mechanism.

3. The development device according to claim 1, wherein the multiple supply ports provided in the development mechanism are disposed so that the developer supplied therethrough is transported a substantially equal distance within the development mechanism by the developer supply member in the axial direction of the developer carrier.

4. The development device according to claim 3, wherein the developer supply member comprises a screw including a blade and a shaft, the blade winding around the shaft in an identical direction so that the screw transports the developer unidirectionally.

5. The development device according to claim 3, wherein the developer supply member comprises a screw including a blade and a shaft, the blade winding around the shaft in opposite directions on both sides of a center portion in a longitudinal direction thereof, wherein the screw transports the developer in opposite directions while rotating unidirectionally.

6. The development device according to claim 1, wherein the transport member to transport the agitated developer from the agitation unit to the development mechanism is an airflow generating system, wherein the developer is transported by an airflow generated by the airflow generating system from the agitation unit to the development mechanism through the developer transport path.

7. The development device according to claim 6, further comprising a discharge unit connected to the agitation unit, into which the developer is discharged from the agitation unit, wherein the developer is divided in the discharge unit, the developer transport path includes a tube and is divided into multiple sub-paths each connected to a respective one of the multiple supply ports provided in the development mechanism, and the developer is transported by the airflow through the multiple sub-paths to the respective supply ports provided in the development mechanism.

8. The development device according to claim 7, further comprising a developer amount adjuster to adjust an amount of the developer supplied through each of the multiple sub-paths to the development mechanism.

9. The development device according to claim 7, further comprising a partition member to divide the airflow generated by the airflow generating system into multiple airflows each supplied to the respective one of the multiple sub-paths of the developer transport path.

10. The development device according to claim 7, wherein the airflow generating system comprises multiple airflow supplying members to supply an airflow to each of the multiple sub-paths of the developer transport path.

11. The development device according to claim 7, wherein the discharge unit comprises:

a discharge space defined by multiple walls including a first wall and a second wall opposite the first wall; and a feeder connected to the discharge space, to send the developer from the agitation unit to the discharge space, wherein an air inlet through which the airflow generated by the airflow generating system flows is formed in the first wall, and multiple openings respectively communicating with the multiple sub-paths are formed in the second wall.

12. The development device according to claim 7, wherein the sub-paths of the developer transport path that respectively connect the multiple supply ports and the discharge unit into which the developer is discharged from the agitation unit have a substantially equal length.

13. The development device according to claim 1, wherein the discharge port provided in the development mechanism is disposed in a downstream end portion in a direction in which the developer collected from the developer carrier is transported by the developer collection member.

14. A development device comprising:

a development mechanism, including multiple supply ports through which developer is supplied to the development mechanism, a discharge port through which the developer is discharged from the development mechanism, a developer carrier to carry the developer to develop a latent image, and a developer transport member extending in a direction parallel to an axial direction of the developer carrier, to transport the developer within the development mechanism in the direction parallel to the axial direction of the developer carrier;

an agitation unit connected to the development mechanism, to agitate and mix together developer collected from the development mechanism and fresh toner; and a transport member to transport the agitated developer from the agitation unit to the multiple supply ports provided in the development mechanism through a developer transport path, wherein the multiple supply ports are disposed at different positions in the development mechanism in the axial direction of the developer carrier, and the developer transport member supplies the developer to the developer carrier while collecting the developer from the developer carrier.

15. The development device according to claim 14, wherein the developer transport path comprises a tube and is divided into multiple sub-paths each connected to a respective one of the multiple supply ports provided in the development mechanism.

16. The development device according to claim 14, wherein the multiple supply ports provided in the development mechanism are disposed so that the developer supplied therethrough is transported a substantially equal distance within the development mechanism by the developer transport member in the axial direction of the developer carrier.

17. The development device according to claim 14, wherein the transport member to transport the agitated developer from the agitation unit to the development mechanism is an airflow generating system, wherein the developer is transported by an airflow generated by the airflow generating system from the agitation unit to the development mechanism through the developer transport path.

18. The development device according to claim 17, further comprising a discharge unit connected to the agitation unit, into which the developer is discharged from the agitation unit, wherein the developer is divided in the discharge unit, the developer transport path includes a tube and is divided into multiple sub-paths each connected to a respective one of the multiple supply ports provided in the development mechanism, and the developer is transported by the airflow through the multiple sub-paths to the respective supply ports provided in the development mechanism.

19. The development device according to claim 18, further comprising a developer amount adjuster to adjust an amount of the developer supplied through each of the multiple sub-paths to the development mechanism.

20. An image forming apparatus comprising:

a latent image carrier;

a latent image forming unit to form a latent image on the latent image carrier; and a development device to develop the latent image with developer, the development device comprising:

a development mechanism, including multiple supply ports through which the developer is supplied to the development mechanism, a discharge port through which the developer is discharged from the development mechanism, a developer carrier to carry the developer, a developer supply member extending in a direction parallel to the axial direction of the developer carrier, to supply the developer to the developer carrier while transporting the developer in the direction parallel to the axial direction of the developer carrier, and a developer collection member disposed in parallel to the developer supply member, to collect the developer from the developer carrier;

an agitation unit connected to the development mechanism, to agitate and mix together developer collected from the development mechanism and fresh toner;

a transport member to transport the agitated developer from the agitation unit to the multiple supply ports provided in the development mechanism through a developer transport path, wherein the multiple supply ports are disposed at different positions in the development mechanism in the axial direction of the developer carrier.

* * * * *